US005669054A

United States Patent [19]

Uchida et al.

[11] Patent Number: 5,669,054

[45] Date of Patent: Sep. 16, 1997

[54] MULTI-DIRECTIONAL DRIVING MECHANISM AND TRANSFER DEVICE FOR AN IMAGE FORMING MACHINE USING SUCH MECHANISM

[75] Inventors: Michio Uchida; Ryuji Wataki; Noritaka Okazaki; Shigeo Fujita; Yuzuru Nanjo, all of Osaka, Japan

[73] Assignee: Mita Industrial Co., Ltd., Osaka, Japan

[21] Appl. No.: 559,604

[22] Filed: Nov. 20, 1995

[30] Foreign Application Priority Data

Nov. 21, 1994 [JP] Japan ..... 6-309485

[51] Int. Cl.[6] ..... G03G 15/14

[52] U.S. Cl. ..... 399/313; 399/121

[58] Field of Search ..... 355/271, 273, 355/277, 296; 399/297, 303, 312, 313, 314, 317, 318, 121

[56] References Cited

U.S. PATENT DOCUMENTS 5,148,224 9/1992 Yamada et al. ..... 399/312
5,175,589 12/1992 Kimura ..... 355/271
5,191,378 3/1993 Itaya et al. ..... 399/313
5,233,393 8/1993 Yoshida et al. ..... 399/313
5,398,107 3/1995 Bartholmae et al. ..... 355/273
5,488,467 1/1996 Marentes et al. ..... 271/273 X
5,572,305 11/1996 Hayashi et al. ..... 399/313 X
5,574,550 11/1996 Okazaki et al. ..... 399/313
5,602,634 2/1997 Uchida et al. ..... 399/313

*Primary Examiner*—S. Lee
*Attorney, Agent, or Firm*—Antonelli, Terry, Stout & Kraus, LLP.

[57] ABSTRACT

A multi-directional driving mechanism includes a moving plate supported rotatably on a supporting shaft and having an input portion and a plurality of output portions, a solenoid coupled to the input portion of the moving plate for causing the moving plate to pivot through a predetermined angle, and a plurality of coupling members each having one end coupled to the plurality of output portions provided on the moving plate. A transfer device for an image forming machine has contacting/separating mechanisms for moving a transfer belt unit, a moving mechanism for moving a cleaning blade, and the multi-directional driving mechanism, the other end each of the plurality of coupling members of the multi-directional driving mechanism being coupled to the contacting/separating mechanisms or the moving mechanism.

7 Claims, 20 Drawing Sheets

MULTI-DIRECTIONAL DRIVING MECHANISM AND TRANSFER DEVICE FOR AN IMAGE FORMING MACHINE USING SUCH MECHANISM

FIELD OF THE INVENTION

This invention relates to a multi-directional driving mechanism capable of reciprocating driving in a plurality of directions using a single solenoid, and to a transfer device for an image forming machine using such driving mechanism.

DESCRIPTION OF THE PRIOR ART

As a transfer device to be mounted on an image forming machine, such as an electrophotographic apparatus or an electrostatic recording apparatus, Japanese Laid-Open Patent Publication No. Hei 4-345183, for instance, discloses a transfer system which has a transfer belt unit disposed opposite an image bearing member, the transfer belt unit comprising a driving roller, a driven roller disposed at a distance from the driving roller, a transfer belt looped around the driving roller and the driven roller, and a transfer roller disposed opposite the image bearing member with the transfer belt interposed therebetween. The transfer system applies a high voltage to the transfer roller to charge the transfer belt to a predetermined polarity, thereby sequentially attracting and transferring a toner image, formed on the surface of the image bearing member, to transfer papers fed between the image bearing member and the transfer belt. A transfer device with such a transfer system is equipped with a cleaning blade disposed in pressure contact with the surface of the transfer belt in order to remove toner adhered to the surface of the transfer belt.

In the above-described transfer system, if the transfer belt is pressed against the image bearing member during a non-transfer operation, it is easily deformed or deteriorated at an early stage. To prevent this situation, or to deal readily with a jam of a transfer paper, if any, between the image bearing member and the transfer belt, the transfer belt unit is adapted to separate from the image bearing member during non-transfer intervals. Furthermore, if the cleaning blade is in contact, under pressure, with the transfer belt during non-transfer intervals, the transfer belt may be permanently deformed, adversely affecting transfer performance. Thus, the cleaning blade is desirably adapted to be moved to a non-operating position during non-transfer intervals.

However, installing not only a driving mechanism for driving a contacting/separating mechanism which moves the transfer belt unit between a transfer position and a non-transfer position, but also a driving mechanism for driving a moving mechanism which moves the cleaning blade to the non-operating position during non-transfer intervals would pose the problems of requiring a complicated structure and a high cost. With a driving mechanism using an electric motor as a driving source, the use of a gear mechanism or a cam mechanism enables the driving mechanism to produce multi-directional outputs from the single driving source however, the use of a driving source operating in a reciprocating manner, such as a solenoid, presents difficulty in producing outputs in a plurality of directions by means of a relatively simple construction.

SUMMARY OF THE INVENTION

A first object of the present invention is to provide a multi-directional driving mechanism capable of producing outputs in a plurality of directions by means of a relatively simple structure using a solenoid as a driving source.

A second object of the present invention is to provide a transfer device for an image forming machine adapted to actuate a contacting/separating mechanism for the transfer belt unit, and a moving mechanism for the cleaning blade, by means of the above multi-directional driving mechanism.

To attain the first object, a first aspect of the present invention provides a multi-directional driving mechanism comprising a moving plate supported pivotably on a supporting shaft and having an input portion and a plurality of output portions; a solenoid coupled to the input portion of the moving plate for causing the moving plate to move at a predetermined angle; and a plurality of coupling members, each having one end coupled to the plurality of output portions provided on the moving plate.

In the multi-directional driving mechanism according to the present invention, when the solenoid is energized, the moving plate, having the input portion coupled to the solenoid, is caused to move at a predetermined angle in a predetermined direction about the supporting shaft. The movement of the moving plate in the predetermined direction permits simultaneous outputs in a plurality of directions via the coupling members coupled to the plurality of output portions provided on the moving plate.

To attain the second object, a second aspect of the present invention provides a transfer device for an image forming machine, which has a belt unit including a driving roller, a driven roller disposed at a distance from the driving roller, and a transfer belt looped around the driving roller and the driven roller and disposed opposite the image bearing member and a cleaning means disposed on the side opposite the image bearing member to clean the surface of the transfer belt wherein a multi-directional driving mechanism is further provided which comprises a contacting/separating mechanism for moving the belt unit between a transfer position and a non-transfer position, a moving mechanism for moving the cleaning means between an operating position and a non-operating position, a moving plate supported pivotably on a supporting shaft and having an input portion and a plurality of output portions, a solenoid coupled to the input portion of the moving plate for causing the moving plate to move at a predetermined angle, and a plurality of coupling members each having one end coupled to a plurality of output portions provided on the moving plate, the other end each of the plurality of coupling members of the multi-directional driving mechanism being coupled to the contacting/separating mechanism or the moving mechanism.

In the transfer device of an image forming machine according to the present invention, when the solenoid constituting the multi-directional driving mechanism is energized during transfer, the moving plate having the input portion coupled to the solenoid is caused to pivot through a predetermined angle in a predetermined direction about the supporting shaft. The movement of the moving plate in the predetermined direction results in the actuation of the contacting/separating mechanism via the coupling member having one end coupled to one of the output portions of the moving plate, whereby the belt unit is brought to the transfer position. The movement of the moving plate in the predetermined direction, moreover, results in the actuation of the moving mechanism via the coupling member having one end coupled to another of the output portions of the moving plate, whereby the cleaning means is brought to the operating position.

Other objects and features of the present invention will become apparent from the following description.

DETAILED DESCRIPTION OF THE PREFERRED EMBODIMENTS

Preferred embodiments of the transfer device for an image forming machine having a multi-directional driving mechanism constructed in accordance with the present invention will be described in detail below with reference to the accompanying drawings.

Figure 1:
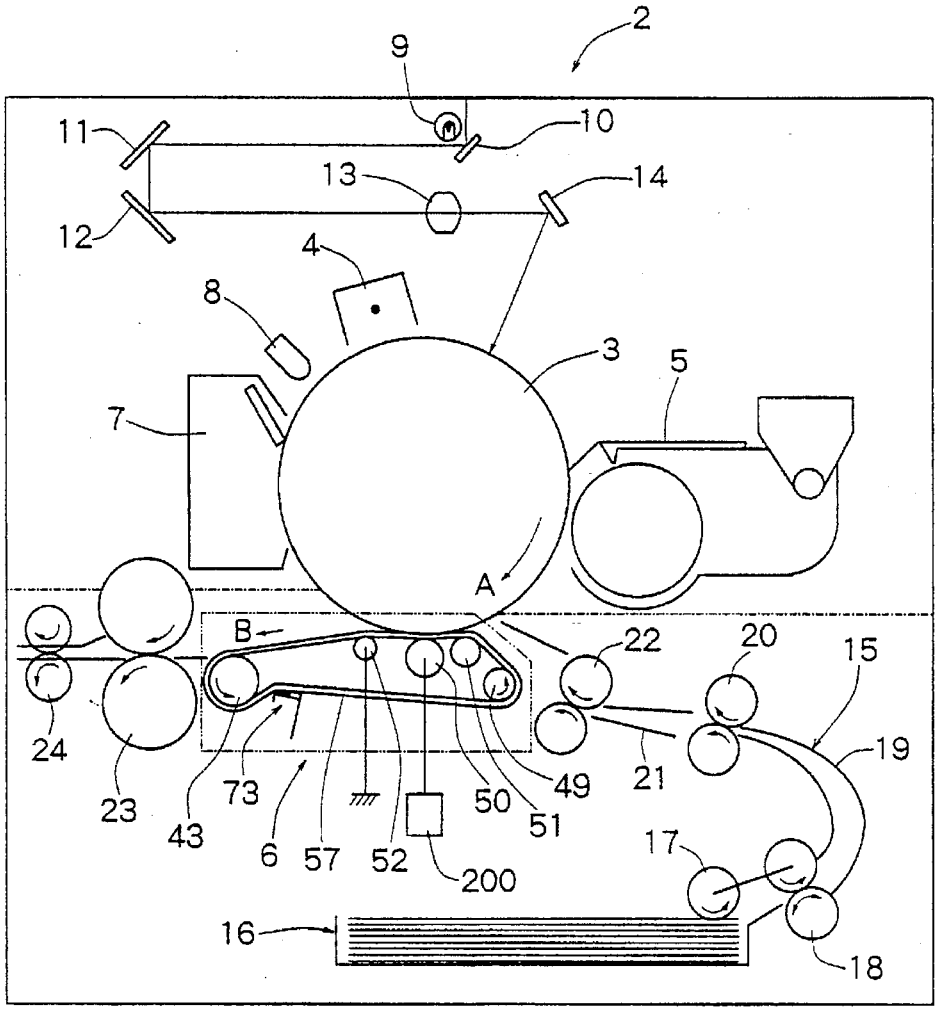
FIG. 1 is an abridged structural view showing an embodiment of an image forming machine equipped with a transfer device having a multi-directional driving mechanism applied thereto which is constructed in accordance with the present invention
Figure 2:
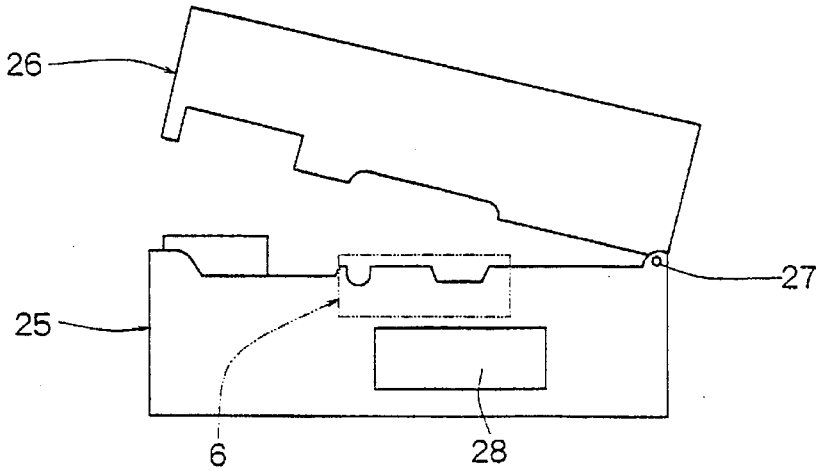
FIG. 2 is a front view of an image forming machine of a clamshell type equipped with the transfer device constructed in accordance with the present invention.

FIG. 1 is an abridged structural view showing an embodiment of an image forming machine equipped with a transfer device constructed in accordance with the present invention. FIG. 2 is a front view of an image forming machine equipped with the transfer device of the present invention.

An image forming machine 2 shown in FIG. 1 has an image bearing member 3, comprising a photosensitive drum, mounted rotatably therein. Around the image bearing member 3 are disposed sequentially as viewed in the direction of rotation indicated by arrow A a charging corona discharger 4, a developing device 5, a transfer device 6 constructed in accordance with the present invention, a cleaning unit 7, and a destaticizing lamp 8. The illustrated image forming machine 2 has an optical system disposed above the image bearing member 3 and composed of an illuminating lamp 9, a first mirror 10, a second mirror 11, a third mirror 12, a lens 13, and a fourth mirror 14. This optical system is adapted to cast light on a document, placed on a document bearing transparent panel (not shown), by way of the illuminating lamp 9, and to focus an image of reflected light on the image bearing member 3 via the first mirror 10, second mirror 11, third mirror 12, lens 13, and fourth mirror 14. The image forming machine 2 has a transfer paper feeder 15 for feeding a transfer paper to the transfer device 6. The transfer paper feeder 15 has a transfer paper cassette 16 for accommodating transfer papers, a transfer paper delivery roller 17, a paper feed roller pair 18, a guide passage 19, a carriage roller pair 20, a guide passage 21, and a resist roller pair 22. On the transfer paper feed-off side of the transfer device 6 are disposed a fixing roller pair 23 and a discharge roller pair 24. In the thus constituted image forming machine, the respective members located below the one-dot chain line in FIG. 1 are disposed in a lower housing 25 of a machine body housing of a clamshell type, shown in FIG. 2, while the respective members located above the one-dot chain line in FIG. 1 are disposed in an upper housing 26. The upper housing 26 has its right-hand lower end mounted by a shaft 27 on the lower housing 25 so as to be free to pivot, as shown in FIG. 2. The transfer device 6 is disposed at a central portion of the lower housing 25, as shown by a two-dot chain line in FIG. 2. A front side plate of the lower housing 25 is provided with an opening 28 for mounting the transfer paper cassette 16.

The image forming machine 2 constructed as above works in the following manner: While the image bearing member 3 is being rotationally driven in the direction of arrow A, the charging corona discharger 4 charges the photosensitive material on the image bearing member 3 to a specific polarity substantially uniformly. Then, the illuminating lamp 9 illuminates a document placed on the document bearing transparent panel (not shown). An image of reflected light therefrom is projected onto the image bearing member 3 via the first mirror 10, second mirror 11, third mirror 12, lens 13 and fourth mirror 14, thereby forming a latent electrostatic image on the image bearing member 3. Then, the latent electrostatic image on the image bearing member 3 is developed to a toner image by the developing device 5. Separately, a transfer paper housed in the transfer paper cassette 16 of the transfer paper feeder 15 is delivered by the transfer paper delivery roller 17, and conveyed to the transfer device 6 past the paper feed roller pair 18, the guide passage 19, the carriage roller pair 20, the guide passage 21, and the resist roller pair 22. The transfer paper conveyed to the transfer device 6 is passed between the image bearing member 3, having the toner image formed thereon, and a transfer belt (to be described later) of the transfer device 6, whereby the toner image is transferred onto the transfer paper. Then, the transfer paper has the toner image fixed by the fixing roller pair 23 and is discharged by the discharge roller pair 24. The image bearing member 3 having a transfer step completed in this manner is cleared of the toner, adhered onto the surface of the photosensitive material, by means of the cleaning unit 7. Further, the surface of the photosensitive material is irradiated with destaticizing light by the destaticizing lamp 8 for static elimination.

Figure 3:
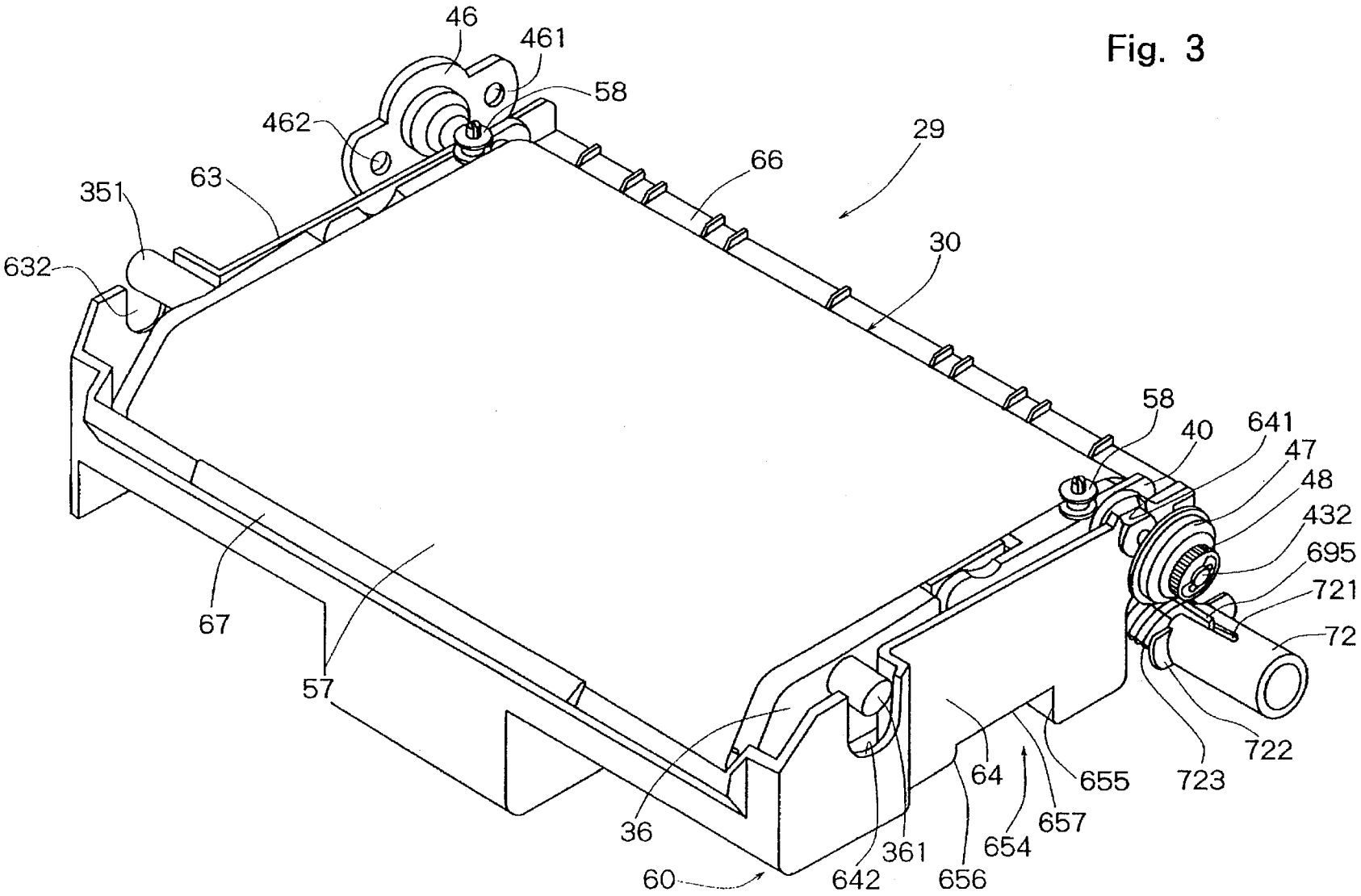
FIG. 3 is a perspective view of a transfer belt unit of a transfer device constructed in accordance with the present invention.
Figure 4:
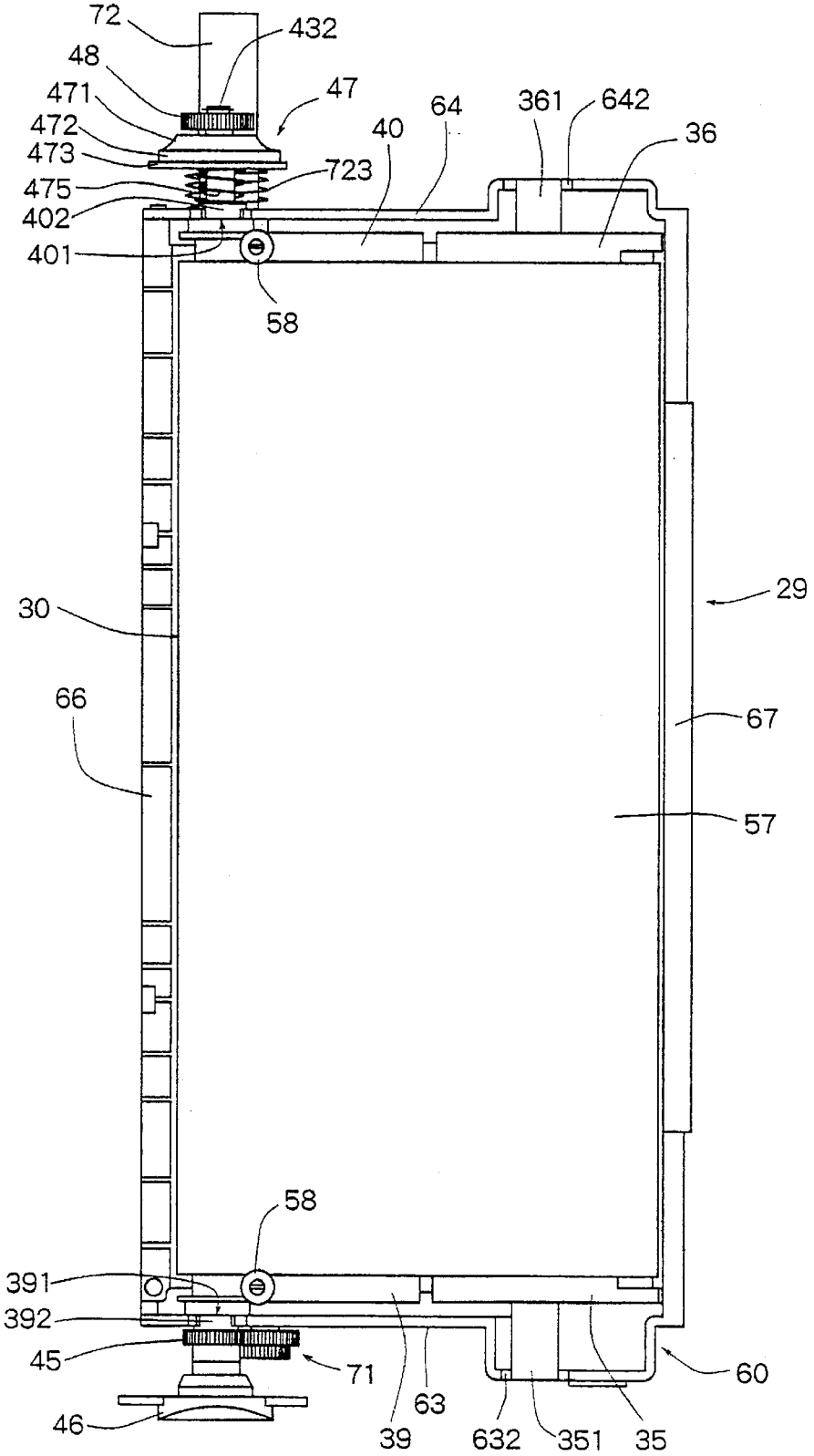
FIG. 4 is a plan view of the transfer belt unit shown in FIG. 3.
Figure 5:
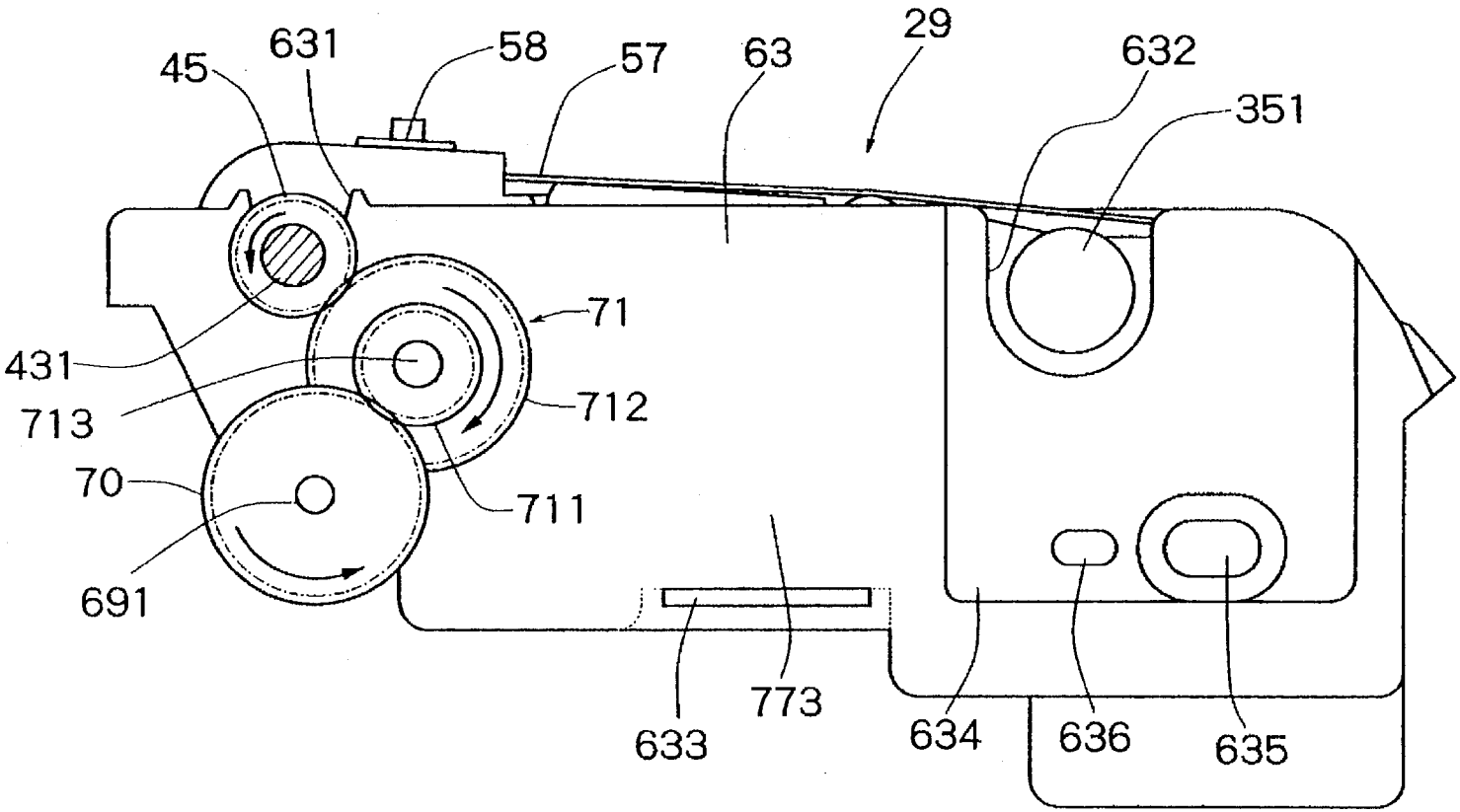
FIG. 5 is a front view, partly broken away, of the transfer belt unit shown in FIG. 3.
Figure 6:
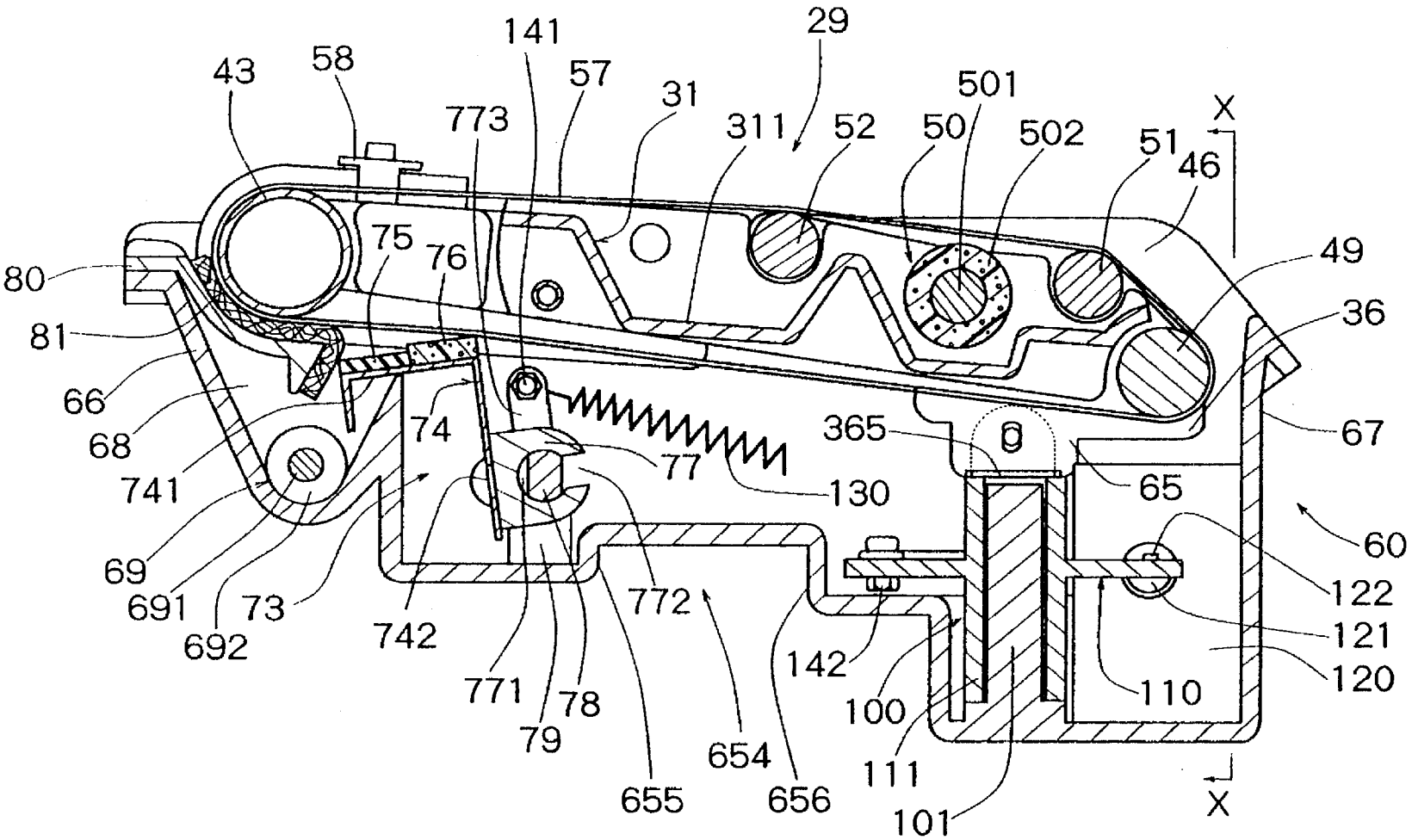
FIG. 6 is a sectional view of the transfer belt unit shown in FIG. 3.
Figure 7:
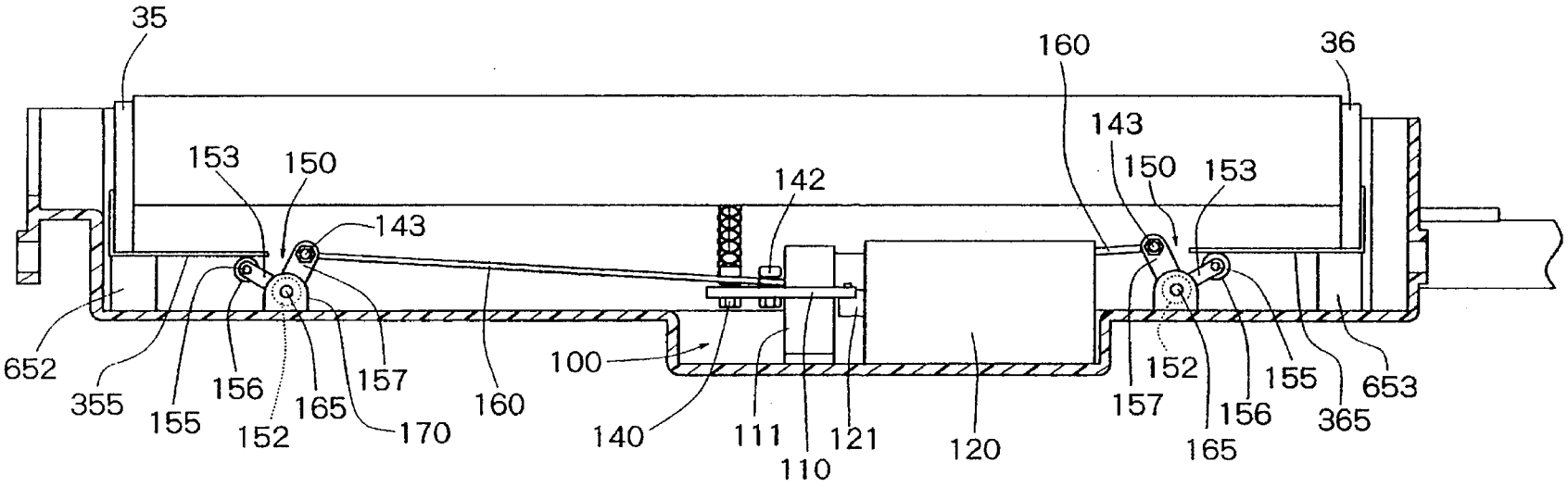
FIG. 7 is a sectional view taken on line X—X of FIG. 6.

Next, the transfer device 6 will be described with reference to FIGS. 3 to 21. FIG. 3 is a perspective view of a transfer belt unit of the transfer device. FIG. 4 is a plan view of the transfer belt unit. FIG. 5 is a front view, partly broken away, of the transfer belt unit. FIG. 6 is a sectional view of the transfer belt unit. FIG. 7 is a sectional view taken on line X—X of FIG. 6. A transfer belt unit 29 illustrated in these Figures has a belt unit 30, and a unit housing 60 for housing and holding the belt unit 30.

Figure 8:
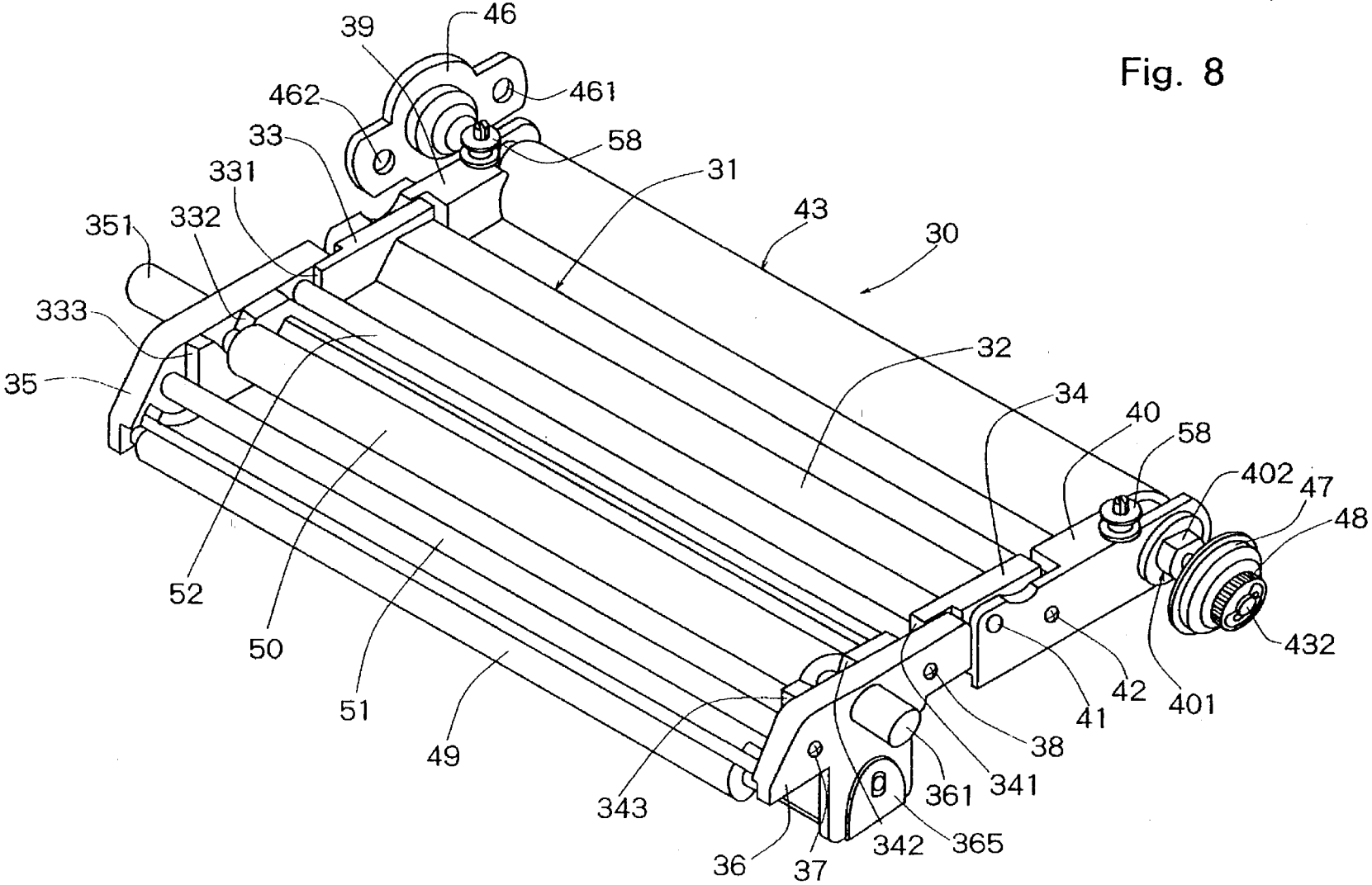
FIG. 8 is a perspective view of a belt unit constituting the transfer belt unit shown in FIG. 3.
Figure 9:
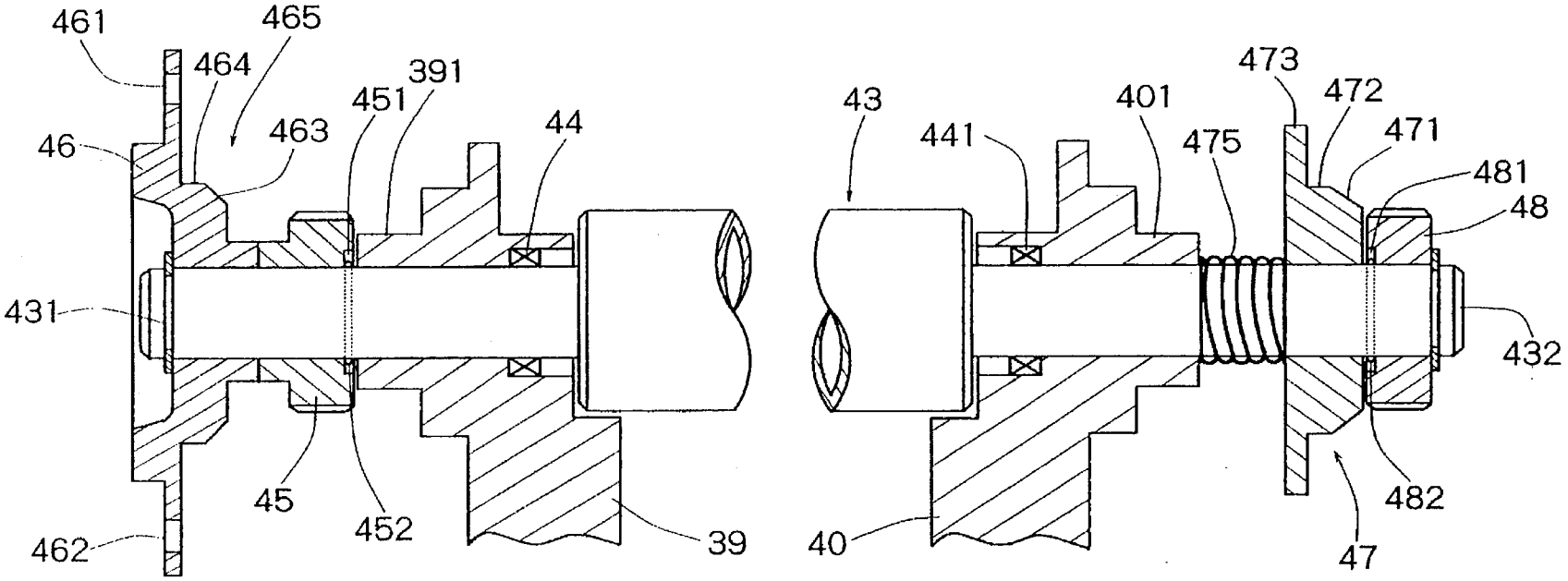
FIG. 9 is a sectional view of a driving roller suitable for the belt unit shown in FIG. 8.
Figure 10:
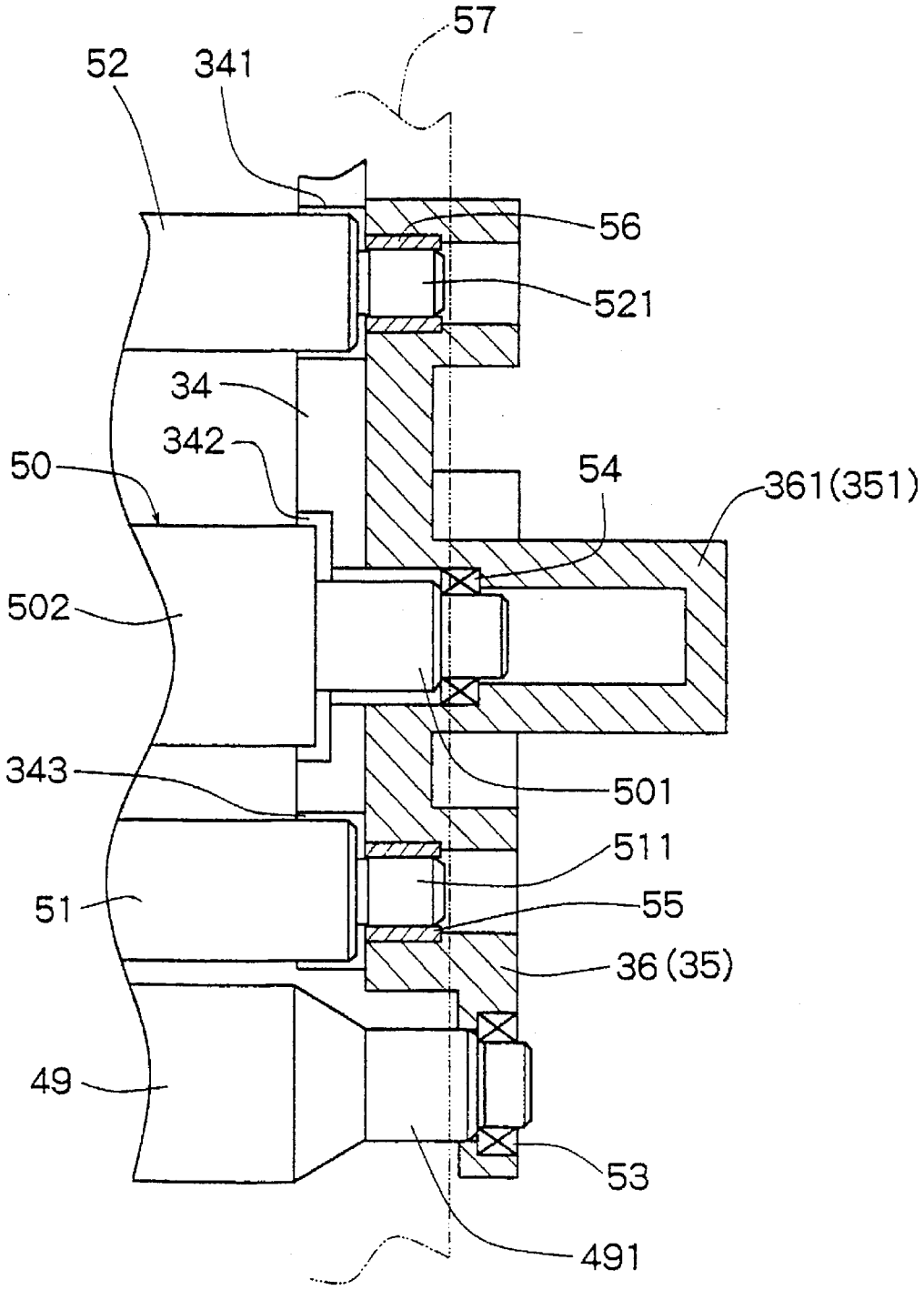
FIG. 10 is a sectional view showing a suitable supporting structure for the respective rollers of the belt unit illustrated in FIG. 8.

The belt unit 30 will be described mainly with reference to FIGS. 8, 9 and 10. The illustrated belt unit 30 has a supporting frame 31 as clearly shown in FIG. 8. The supporting frame 31 has a base portion 32 and end walls 33 and 34 formed, respectively, at the front end and the rear end of the base portion 32, and these are molded integrally from a plastic material. In the end walls 33 and 34 are formed, respectively, notched portions 331, 332, 333 and 341, 342, 343 which are all open upwards. To the end walls 33 and 34 are attached, by means of screws 37, 38 (FIG. 8 shows only those on the end wall 34 side), supporting plates 35 and 36 formed of a plastic material and supporting the respective rollers to be described later. At the central portions of the supporting plates 35 and 36, cylindrical stoppers 351 and 361 projecting forward (upper-leftward in FIG. 8) and rearward (lower-rightward in FIG. 8) are integrally formed. These stoppers 351 and 361 function to contact the underside of a holder for rotatably supporting the image bearing member 3 and regulate the positional relationship between the belt unit 30 and the image bearing member 3. Also, a part of each of the supporting plates 35 and 36 protrudes downwardly, and placing plates 355 and 365 are mounted to these protruding undersides (see FIG. 7).

On the end walls 33 and 34 of the supporting frame 31 are mounted plastic supporting plates 39 and 40 for supporting a driving roller to be described later. The supporting plates 39 and 40 are joined to side end portions of the supporting plates 35 and 36 by pins 41 (FIG. 8 shows only that on the supporting plate 40 side) so as to be free to pivot, and by screws 42 (FIG. 8 shows only that on the supporting plate 40 side) so as to be set in place. On the outside surfaces of the supporting plates 39 and 40 are provided, respectively, disk-shaped mounting portions 391 and 401. The mounting portions 391 and 401 are provided, respectively, with two parallel surfaces 392, 392 and 402, 402 on their outer peripheries (see also FIG. 4).

Between the supporting plates 39 and 40 is disposed a driving roller 43. The driving roller 43 is formed of a hollow material made of an aluminum alloy as illustrated in FIG. 9. To its front end (left end in FIG. 9) and rear end (right end in FIG. 9) are attached rotating shafts 431 and 432. The front rotating shaft 431 is journaled rotatably on a bearing 44 disposed in the supporting plate 39. On the front rotating shaft 431 is mounted a gear 45, which is adapted to turn integrally with the rotating shaft 431 because an engagement groove 451 formed on the side surface of the gear 45 engages a pin 452 disposed so as to pass diametrically through the rotating shaft 431. To a front end portion of the rotating shaft 431 is rotatably mounted a detachable member 46 having holes 461 and 462 for passage of mounting bolts. The detachable member 46 is provided with a position restricting means 465 which includes a guide portion 463 having a conical surface and a fitting portion 464 formed in continuation with the outer periphery of the guide portion 463. The functions of the thus constituted detachable member 46 will be described later.

The rear rotating shaft 432 is journaled rotatably on a bearing 441 disposed in the supporting plate 40. To the rear rotating shaft 432 is rotatably mounted a position restricting member 47, which is pressed rightward in FIG. 8 by a coiled spring 475 disposed between the position restricting member 47 and the mounting portion 401 of the supporting plate 40. The position restricting member 47 includes a guide portion 471 having a conical surface, a fitting portion 472 formed in continuation with the outer periphery of the guide portion 471, and a flange portion 473. The functions of the thus constituted position restricting member 47 will be described later. On the rear rotating shaft 432 is mounted a driven gear 48, which is adapted to turn integrally with the rotating shaft 432 because an engagement groove 481 formed on the side surface of the gear 48 engages a pin 482 disposed so as to pass diametrically through the rotating shaft 432.

Between the supporting plates 35 and 36 are disposed a driven roller 49, a transfer roller 50, a tension roller 51, and an earth roller 52. The supporting structure on the supporting plate 35 side for these respective rollers, and that on the supporting plate 36 side for them are identical, and so only the supporting structure on the supporting plate 36 side is shown in FIG. 10.

The driven roller 49 is formed from a cylindrical material made of an aluminum alloy, and its opposite end portions each terminate in a rotating shaft 491 of a reduced diameter. The rotating shaft 491 is rotatably journaled on a bearing 53 mounted on the supporting plate 36 (35).

The transfer roller 50 comprises a rotating shaft 501 formed from a cylindrical material made from a steel product, and a spongy roller portion 502 mounted on the outer peripheral surface of the rotating shaft 501 using a conductive adhesive (see also FIG. 6). The roller portion 502 is made by impregnating a roll member, formed of a foam such as urethane foam or silicone foam, with a conductive substance such as carbon. The volume resistivity of the roller portion 502 is set at $10^2$ to $10^9$ Ωcm. The impregnation of the roll member constituting the roller portion 502 with the conductive substance can be performed, for example, by dipping the roll member, formed of a foam such as urethane foam or silicone foam, in a solution of a powder of a conductive substance such as carbon to impregnate the roll member with the solution, and then drying it. The hardness of the roller portion 502 is set at a compression of 0.45 to 2.00 mm at a linear pressure of 3 g/cm.

The reason why the roller portion 502 of the transfer roller 50 is composed of a relatively soft material such as a foam, e.g., urethane foam or silicone foam, having hardness expressed by a compression of 0.45 to 2.00 mm at a linear pressure of 3 g/cm is as follows: Our tests showed that when the roller portion of the transfer roller was composed of a relatively hard material such as hard rubber, the pressure at the transfer point was high, and no problem occurred with an ordinary transfer paper. However, for an OHP film or the like, to which toner adheres with difficultly a partial missing phenomenon tended to occur in which the middle of the line of the image remains on the image bearing member without being transferred to the film. In the light of this finding, we tested various transfer rollers made of urethane foams. The volume resistivity of the roller portion of the transfer roller was set at $10^5$ Ωcm, the volume resistivity of the transfer belt at $10^{11}$ Ωcm, and the voltage applied to the transfer roller at 2.5 kV. The tests showed that when the hardness of the roller portion was represented by a compression of less than 0.45 mm at a linear pressure of 3 g/cm, the partial missing phenomenon occurred during transfer to an OHP film; whereas when the hardness of the roller portion was lower, no partial missing phenomenon occurred. However, when the hardness of the roller portion was low enough to involve a compression of greater than 2.00 mm at a linear pressure of 3 g/cm, a predetermined frictional force was not obtained, making free-running with the transfer belt difficult. Also, a shearing force developing between the transfer belt and the roller portion damaged the surface of the roller portion. It was thus found that the hardness of the roller portion of the transfer roller should desirably be represented by a compression of 0.45 to 2.00 mm at a linear pressure of 3 g/cm.

The opposite end portions of the rotating shaft 501 constituting the transfer roller 50 are each journaled rotatably by a bearing 54 mounted on the supporting plate 36 (35). The bearing 54 is disposed at that position facing the cylindrical stopper 361 (351) where it is embedded on the stopper 361 (351) side from the internal surface of the supporting plate 36 (35). Therefore, toner powder or dust only minimally penetrates the bearing 54 from inside the supporting plate 36 (35). The rotating shaft 501 of the transfer roller 50 is adapted to be given a predetermined voltage by the voltage applying means 200 shown in FIG. 1.

The tension roller 51 is disposed between the driven roller 49 and the transfer roller 50 and is formed from a cylindrical material made of an aluminum alloy. Its opposite end portions each terminate in a rotating shaft 511 of a reduced diameter. The rotating shaft 511 is rotatably journaled on a bearing 55 mounted on the supporting plate 36 (35).

The earth roller 52 is disposed between the transfer roller 50 and the driving roller 43 and is formed from a cylindrical material made of an aluminum alloy. Its opposite end portions each terminate in a rotating shaft 521 of a reduced diameter. The rotating shaft 521 is rotatably journaled on a bearing 56 mounted on the supporting plate 36 (35). The earth roller 52 is grounded by a suitable grounding means. As seen from FIG. 6, the earth roller 52, the tension roller 51 and the transfer roller 50 are in the following positional relationship: The transfer roller 50 is disposed such that the upper edge of its outer peripheral surface is situated below a straight line connecting together the upper edges of the outer peripheral surfaces of the earth roller 52 and the tension roller 51 as viewed in the drawing. Thus, in a state in which a transfer belt 57 to be described later is wound around these rollers, the transfer roller 50 separates from the transfer belt 57.

An endless transfer belt 57 is wound around the driving roller 43, driven roller 49, transfer roller 50, tension roller 51 and earth roller 52 that are mounted on the supporting plates 39 and 40 and the supporting plates 35 and 36 in the manner noted above. The transfer belt 57 is formed of a semiconductive material such as polychloroprene, and its volume resistivity is set at $10^9$ to $10^{12}$ Ωm. In mounting the transfer belt 57 over the respective rollers, the screws 42 that fix the supporting plates 39 and 40 to the end walls 33 and 34 of the supporting frame 31 are loosened to release the fixing of the supporting plates 39 and 40 to the end walls 33 and 34 of the supporting frame 31, and the supporting plates 39 and 40 are pivoted about the pins 41. By so pivoting the supporting plates 39 and 40 about the pins 41, the transfer belt 57 can be easily fitted over the respective rollers. Then, the supporting plates 39 and 40 are pivoted about the pins 41 to their original positions, and the screws 42 are tightened, whereby the transfer belt 57 can be mounted with a predetermined tension. The width of the transfer belt 57 is set to be larger than the distance between the supporting plates 35 and 39 and the supporting plates 36 and 40. Both ends of the transfer belt 57 are situated at the central portions of the supporting plates 35 and 39 and the supporting plates 36 and 40. Hence, toner powder adhered to the transfer belt 57 only minimally penetrates a space defined by the supporting plates 35, 39, the supporting plates 36, 40, and the transfer belt 57. To prevent the transfer belt 57 from snaking during its operation, anti-snaking members 58, 58 are attached to the upper surfaces of the supporting plates 39 and 40.

Figure 11:
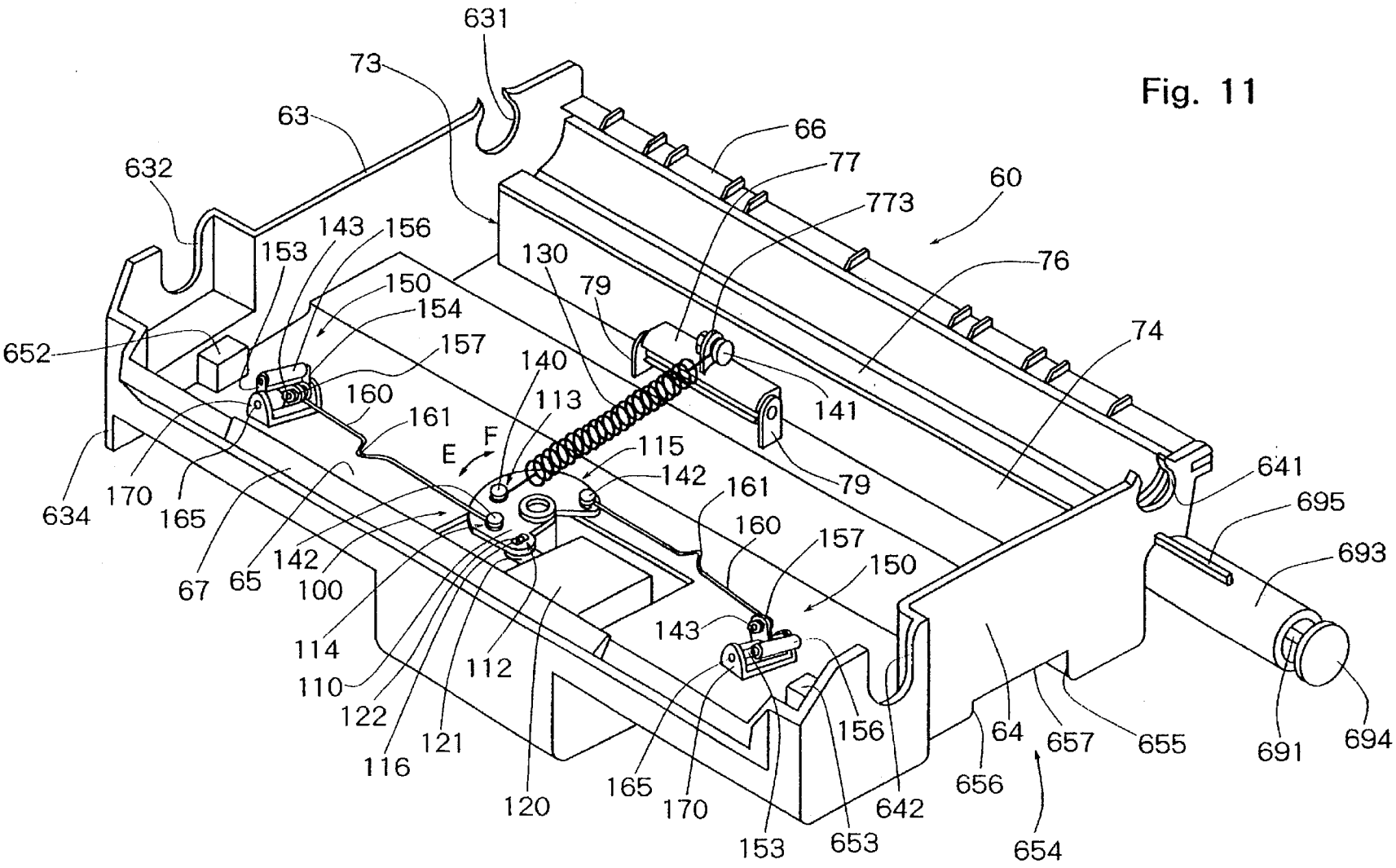
FIG. 11 is a perspective view of a unit housing of the transfer belt unit shown in FIG. 3.
Figure 12:
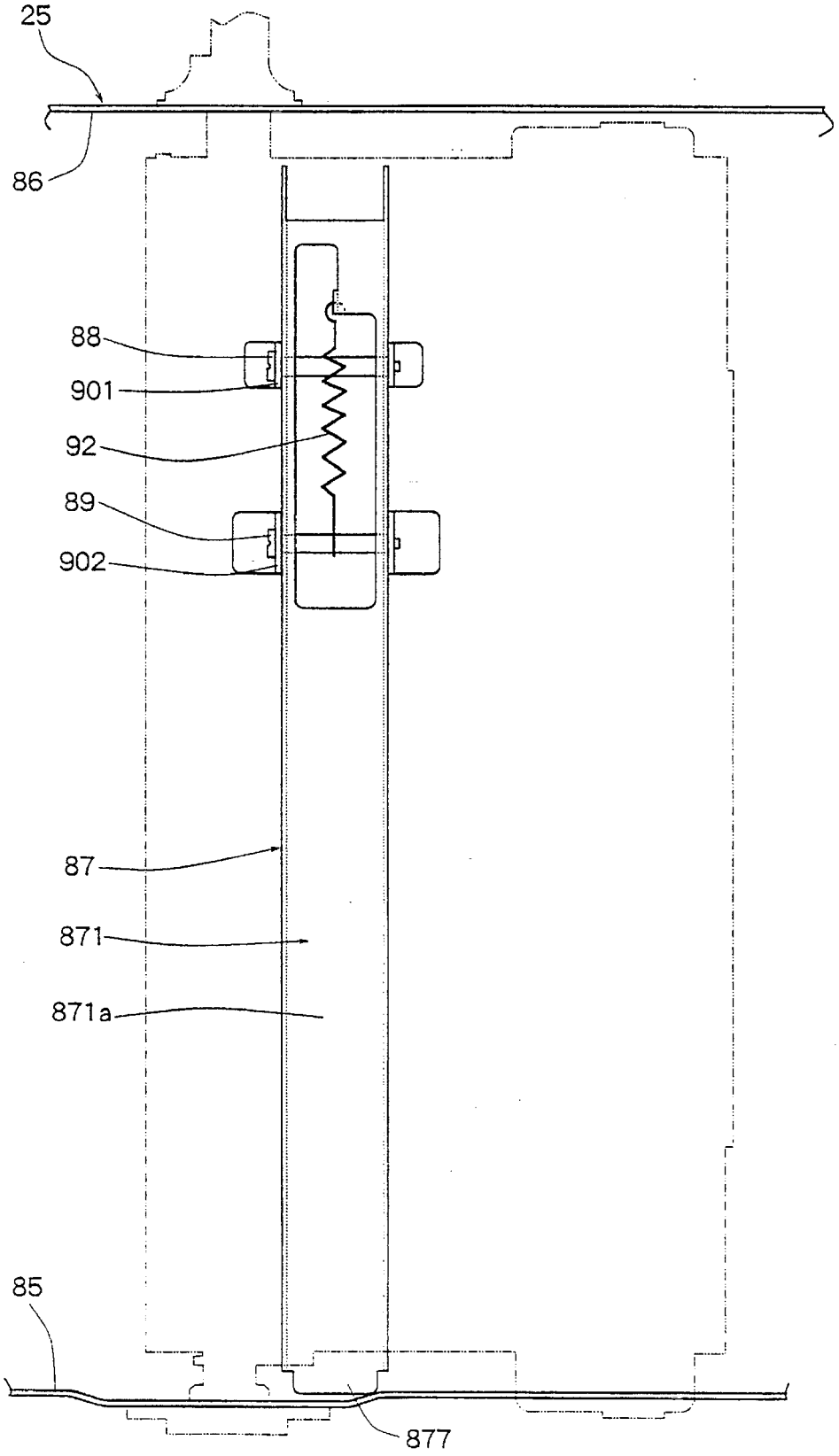
FIG. 12 is a plan view showing a mounting portion of a machine body housing on which the transfer belt unit illustrated in FIG. 3 may be mounted.

Next, a unit housing 60 for accommodating and supporting the belt unit 30 will be described with main reference to FIGS. 6, 7 and 11. The unit housing 60 in the illustrated embodiment, as shown in FIG. 11, has a front side wall 63, a rear side wall 64, a bottom wall 65, a left side wall 66, and a right side wall 67, and is open upwards. These walls are integrally formed of a plastic material. In those upper parts of the front side wall 63 and the rear side wall 64 which are adjacent the left side wall 66 side, there are formed circular supporting holes 631 and 641 which pivotably support the mounting portions 391 and 401 provided on the supporting plates 39 and 40 journaling the driving roller 43 of the belt unit 30. The circular supporting holes 631 and 641 correspond in diameter with the mounting portions 391 and 401 and are open upwards. The width of each opening corresponds with the width of the mounting portions 391 and 40 between the two parallel surfaces 392, 392 and 402, 402 formed in the mounting portions 391 and 401. Thus, the two mounting portions 391 and 401 may be inserted into the circular supporting holes 631 and 641 from above in correspondence with the openings of the circular supporting holes 631 and 641, and the belt unit 30 may be pivoted through approximately 90° about the mounting portions 391 and 401, whereby the belt unit 30 can be mounted on the unit housing 60.

Those end portions of the front side wall 63 and the rear side wall 64 which are adjacent the right side wall 67 side are formed so as to project forward and rearward. In the upper parts of these end portions are formed notched portions 632 and 642 for receiving the stoppers 351 and 361 of the belt unit 30. At the projection of the front side wall 63 where the notched portion 632 is formed is provided a mounting portion 634 protruding downwardly of the bottom wall 65. In the mounting portion 634 are formed an elliptic positioning hole 635 and an elliptic hole 636 for passage of a mounting bolt, as shown in FIG. 5. At a central portion of the front side wall 63 shown in FIG. 5 is formed an engagement hole 633 at a position aligned with a slide rail to be described later. In the bottom wall 65 is provided a slide rail 654 at a position aligned with the engagement hole 633 formed in the front side wall 63, the slide rail 654 extending from the front side end portion to the rear side end portion of the bottom wall 65. The slide rail 654 has guides 655, 656 projecting downwardly on either side thereof, and a slide surface 657 formed between the guides 655 and 656. The slide surface 657 is formed at nearly the same level as the upper end of the engagement hole 633 formed in the front side wall 63.

In that part of the unit housing 60 which is beside the left side wall 66 is formed a waste toner accommodating portion 68, extending in the back-and-forth direction along the left side wall 66, as shown in FIG. 6. In a lower part of the waste toner accommodating portion 68 is disposed a toner carriage member 69. The toner carriage member 69 has a rotating shaft 691 and a spiral blade 692 mounted on the rotating shaft 691. The toner carriage member 69 has an end portion of the rotating shaft 691 journaled rotatably on the front side wall 63. The other end portion of the rotating shaft 691 is open to the waste toner accommodating portion 68, and a part of the spiral blade 692 is supported rotatably by a guide cylinder 693 provided so as to project rearwardly from the rear side wall 64 (see FIG. 11). As seen in FIG. 5, to an end of the rotating shaft 691 is mounted a driven gear 70, which engages a pinion 711 of an intermediate gear 71 journaled rotatably on a shaft 713 provided in the front side wall 63. The intermediate gear 71 has a wheel 712 integrally with the pinion 711, and the wheel 712 is adapted to engage the gear 45 mounted on the rotating shaft 431 of the driving roller 43. The other end portion of the rotating shaft 691 projects beyond the front end of the guide cylinder 693, and has at its front end a blocking disk 694 having nearly the same outside diameter as the outside diameter of the guide cylinder 693. Over the guide cylinder 693 is fitted a blocking cylinder 72 as shown in FIG. 3. The blocking cylinder 72 has an engagement groove 721 formed axially from the internal end thereof. Since the engagement groove 721 engages a ridge 695 provided on the guide cylinder 693, the blocking cylinder 72 can move axially, but its turning is restricted. Also, the blocking cylinder 72 has a flange 722 at its internal end and is pushed rearward by a coiled spring 723 disposed between the flange 722 and the rear side wall 64.

The unit housing 60 has along the waste toner accommodating portion 68 a cleaning means 73 for cleaning the transfer belt 57 of the belt unit 30. The cleaning means 73 in the illustrated embodiment has a common holder 74, a cleaning blade 75, and a paper dust removing member 76. The common holder 74 comprises a channel-like member having nearly the same length as the width of the transfer belt 57, and has a mounting portion 741 and a supporting portion 742. To a central part of the supporting portion 742 of the holder 74 is secured a mounting member 77. The mounting member 77 has at its base portion a hole 771 of a circular cross section drilled through the mounting member 77 in the longitudinal direction and partly having an opening portion 772. At a central portion of the mounting member 77 is integrally formed an operated lever 773. A supporting shaft 78 (see FIG. 6) for pivotably supporting the mounting member 77 is provided at the bottom wall 65 of the unit housing 60. The supporting shaft 78 is formed integrally with supporting walls 79, 79 formed so as to extend from the bottom wall 65, and has two parallel surfaces with dimensions consistent with the diameter of the hole 771 and consistent with the width of the opening of the opening portion 772 at the outer periphery. To mount the mounting member 77 on the supporting shaft 78, the opening portion 772 is aligned with the two parallel surfaces formed on the supporting shaft 78, and the hole 771 is fitted over the supporting shaft 78 from above. Then, the mounting member 77 is pivoted through about 90°, whereby the operated lever 773 is mounted so as to be positioned substantially above supporting shaft 78, as shown in FIGS. 6 and 11.

The cleaning blade 75 is formed of urethane rubber or the like, has nearly the same length as the width of the transfer belt 57, and is secured to the mounting portion 741 of the holder 74 by use of an adhesive or the like. The cleaning blade 75 has its edge in contact with the transfer belt during a transfer operation (see FIG. 21), thereby scraping off toner adhered to the transfer belt 57. The paper dust removing member 76 is composed of a foamed material such as a sponge, has nearly the same length as the width of the transfer belt 57, and is secured to the mounting portion 741 of the holder 74 by use of an adhesive or the like. The paper dust removing member 76 is disposed downstream of the cleaning blade 75 in the direction of operation of the transfer belt 57 and is formed so as to be thicker than the cleaning blade 75. The paper dust removing member 76 is adapted to partially contact the transfer belt 57 during non-transfer intervals as well as during a transfer procedure. The paper dust removing member 76 removes paper dust adhered to the transfer belt 57, which is difficult for the cleaning blade 75 to remove, and has the function of smoothing toner accumulated at the position of contact when the cleaning blade 75 leaves the transfer belt 57.

At an upper end of the left side wall 66 of the unit housing 60 is mounted a sealing plate 80 which covers the top of the waste toner accommodating portion 68. The sealing plate 80 extends from the front side wall 63 to the rear side wall 64, and has a sealing material 81, such as pile wool sponge or felt, on its surface facing the transfer belt 57 and at its portion facing the cleaning blade 75. As shown in FIG. 6, the edge portion of the cleaning blade 75 is brought into contact with the sealing material 81 during non-transfer intervals. Hence the toner or paper dust adhered to the edge portion of the cleaning blade 75 can be removed during each non-transfer intervals.

In the unit housing 60 is disposed a multi-directional driving mechanism 100 for moving the cleaning means 73 between an operating position and a non-operating position, and also for moving the belt unit 30 between a transfer position and a non-transfer position. The multi-directional driving mechanism 100 is supported pivotably on a supporting shaft 101 extending upward from the bottom wall 65 of the unit housing, and has a moving plate 110. The moving plate 110 is formed of a plastic material and has at its center a supporting tubular portion 111 rotatably fitted over the supporting shaft 101. In the illustrated embodiment, the moving plate 110 has an input portion 112 and three output portions 113, 114, 115 adjacent the outer peripheral portion thereof. An elongate hole 116 is provided at the input portion 112, and a pin 122 mounted on a plunger 121 of a solenoid 120 is fitted into and connected to the elongate hole 116. Thus, when the solenoid 120 is energized and the plunger 121 is attracted, the moving plate 110 is moved through a predetermined angle in the direction of arrow E about the supporting shaft 101. When the solenoid 120 is deenergized, the plunger 121 is returned by a built-in return spring whereupon the moving plate 110 is moved in the direction of arrow F about the supporting shaft 101 to its original state.

The three output portions 113, 114, 115 provided on the moving plate 110 reside at angles of nearly 90° to each other. The output portion 113 is connected to the operated lever 773, which constitutes the moving mechanism for the cleaning means 73, by means of a coiled spring 130 as a coupling member. In the illustrated embodiment, a ring is formed at an end of the coiled spring 130, and this ring and a coupling means 140, comprising, for example, a bolt inserted into a hole formed in the input portion 113 and a nut screwed on the bolt, enable that end of the coiled spring 130 to be coupled to the output portion 113 of the moving plate 110. A ring is formed at the other end of the coiled spring 130 as well, and this ring and a coupling means 141, comprising, for example, a bolt inserted into a hole formed in the operated lever 773 and a nut screwed on the bolt, enable that other end of the coiled spring 130 to be coupled to the operated lever 773. The coupling portions at both ends of the coiled spring 130 have connections with some play. The coiled spring 130 is also disposed nearly tangentially to the direction of rotation of the output portion 113. In the illustrated embodiment, the coiled spring 130 is used as a coupling member for connecting the output portion 113 of the moving plate 110 to the operated lever 773. Because of this use, a tensile force is imparted to the coiled spring 130 when the cleaning blade 75 is brought to an operating position during transfer, and even when the transfer belt 57 is stretched, the cleaning blade 75 is kept pressed against the transfer belt 57 owing to the tensile force of the coiled spring 130.

The output portions 114 and 115 are coupled to contacting/separating mechanisms 150 and 150 for the belt unit 30 by means of coupling rods 160 and 160 as coupling members. Each contacting/separating mechanism 150 comprises a bored cylindrical supporting member 152, supporting side portions 153, 154 formed upright at the opposite end portions of the supporting member 152, a roller 156 supported on the supporting side portions 153 and 154 rotatably about a supporting shaft 155, and an operated lever portion 157 formed upright at a central portion of the supporting member 152 at an angle of nearly 90° to the supporting side portions 153 and 154. These elements are molded from a plastic material. The contacting/separating mechanism 150 is rotatably supported by fitting into the hole of the supporting member 152 the supporting shaft 165 which is attached to a bracket 170 mounted on the bottom wall 65 of the unit housing. The rollers 156 and 156 of the contacting/separating mechanisms 150 and 150 are disposed at a position aligning with the undersides of the placing plates 355 and 365 mounted on the undersides of the supporting plates 35 and 36 of the belt unit 30. A ring is formed at one end of each of the coupling rods 160 and 160, and these rings and coupling means 142 and 142, each comprising, for example, a bolt inserted into a hole formed in the output portions 114 and 115 and a nut screwed on the bolt, enable that end of the connecting rods 160 and 160 to be coupled to the output portions 114, 115 of the moving plate 110. A ring is also formed at the other end of each of the coupling rods 160 and 160, and these rings and coupling means 143, 143, each comprising, for example, a bolt inserted into a hole formed in the operated lever portions 157 and 157 of the contacting/separating mechanisms 150 and 150 and a nut screwed on the bolt, enable that other end of the connecting rods 160 and 160 to be coupled to the operated lever portions 157 and 157. In the illustrated embodiment, the connecting rods 160 and 160 have bends 161 and 161 formed at the middle thereof. These bends 161 and 161 formed in the coupling rods 160 and 160 are intended for accommodating manufacturing errors in the distances between the moving plate 110 and the operated lever portions 157 and 157, mounted. The connected portions at both ends of the connecting rods 160 and 160 have connections with some play. The connecting rods 160 and 160 are also disposed nearly tangentially to the direction of rotation of the output portion 113.

Figure 13:
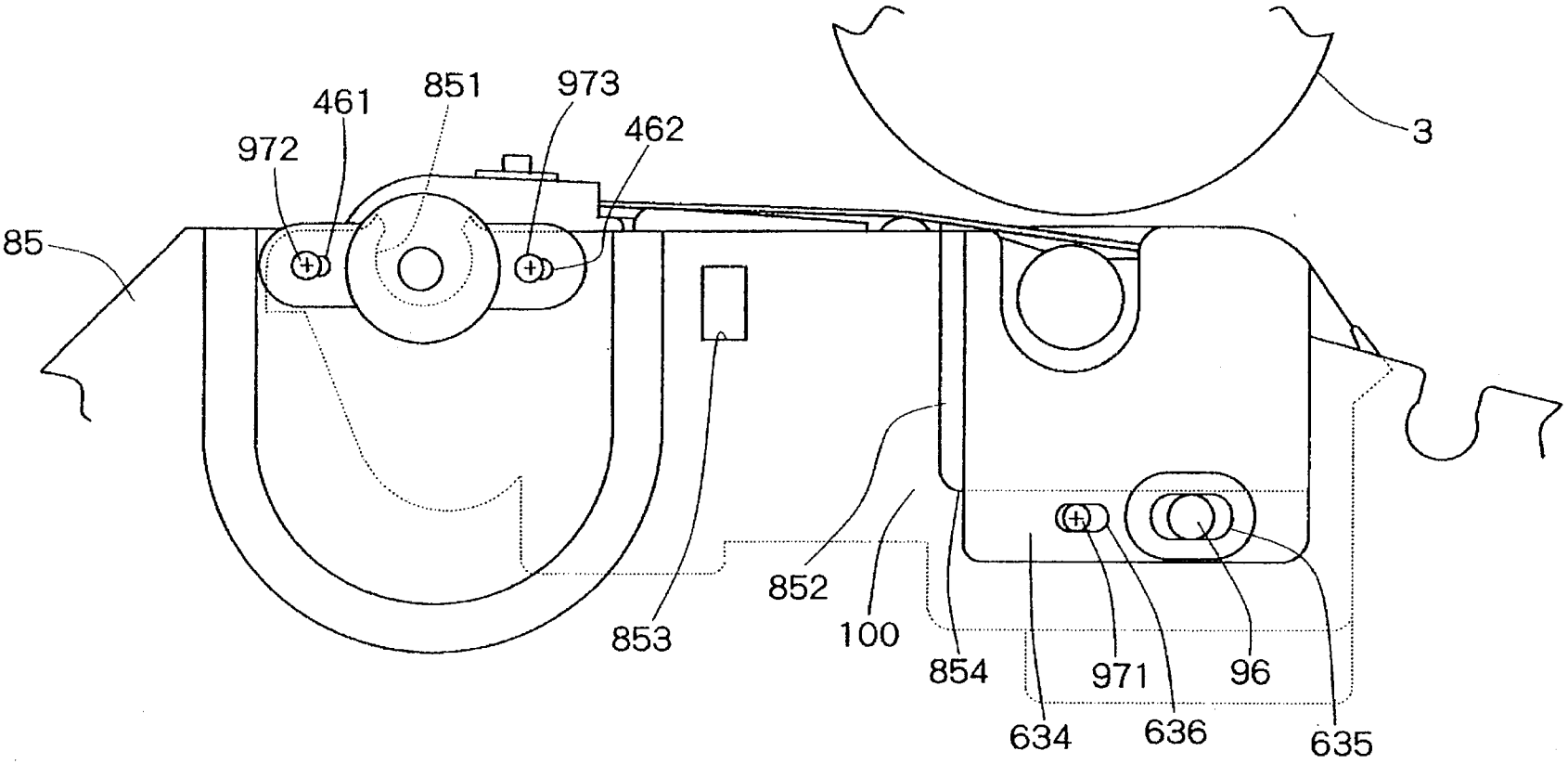
FIG. 13 is a front view showing a state in which the transfer belt unit illustrated in FIG. 3 is mounted on the machine body housing.
Figure 14:
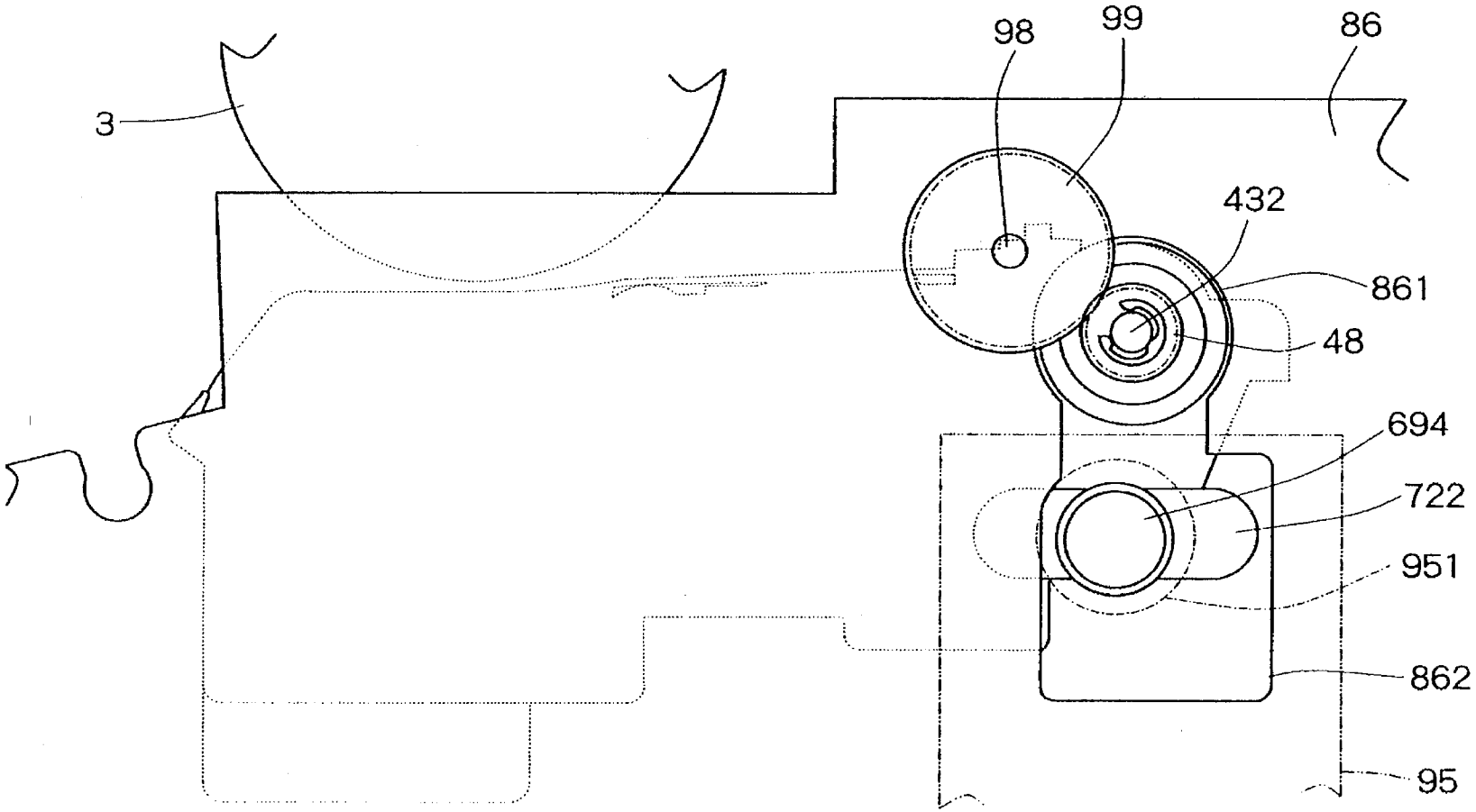
FIG. 14 is a rear view showing a state in which the transfer belt unit illustrated in FIG. 3 is mounted on the machine body housing.

Next, the slider mechanism for mounting the thus constituted transfer belt unit 29 on the lower housing 25 of the clamshell type will be described with reference to FIGS. 12 to 21. The lower housing 25 has a front side plate 85, a rear side plate 86 disposed at a distance from the front side plate 85, and a base plate 90 disposed between the front side plate 85 and the rear side plate 86. The front side plate 85, as shown in FIG. 13, is provided with a circular supporting hole 851 formed so as to be open upwards in correspondence with the fitting portion 464 of the detachable member 46 in the transfer belt unit 29. The front side plate 85 also is provided with a rectangular notched portion 852 in correspondence with the mounting portion 634 formed in the front side wall 63 of the unit housing 60 and is provided with a hole 853 for engaging the engaging portion of a slider to be described later. In the rear side plate 86, as shown in FIG. 14, are provided a hole 861 conforming to the fitting portion 472 of the position restricting member 47 in the transfer belt unit 29, and a hole 862 which can be passed through by the blocking cylinder 72.

Figure 15:
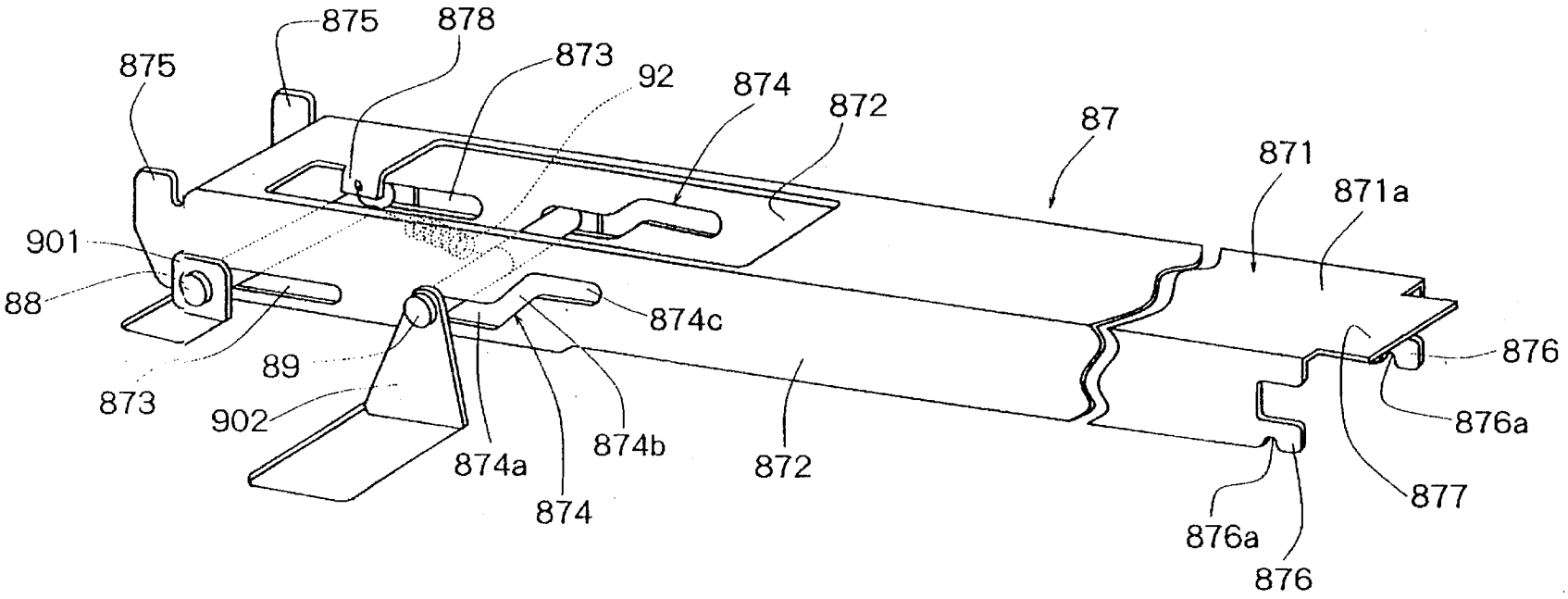
FIG. 15 is a perspective view of a slider for mounting the transfer belt unit of FIG. 3 on the machine body housing.
Figure 16:
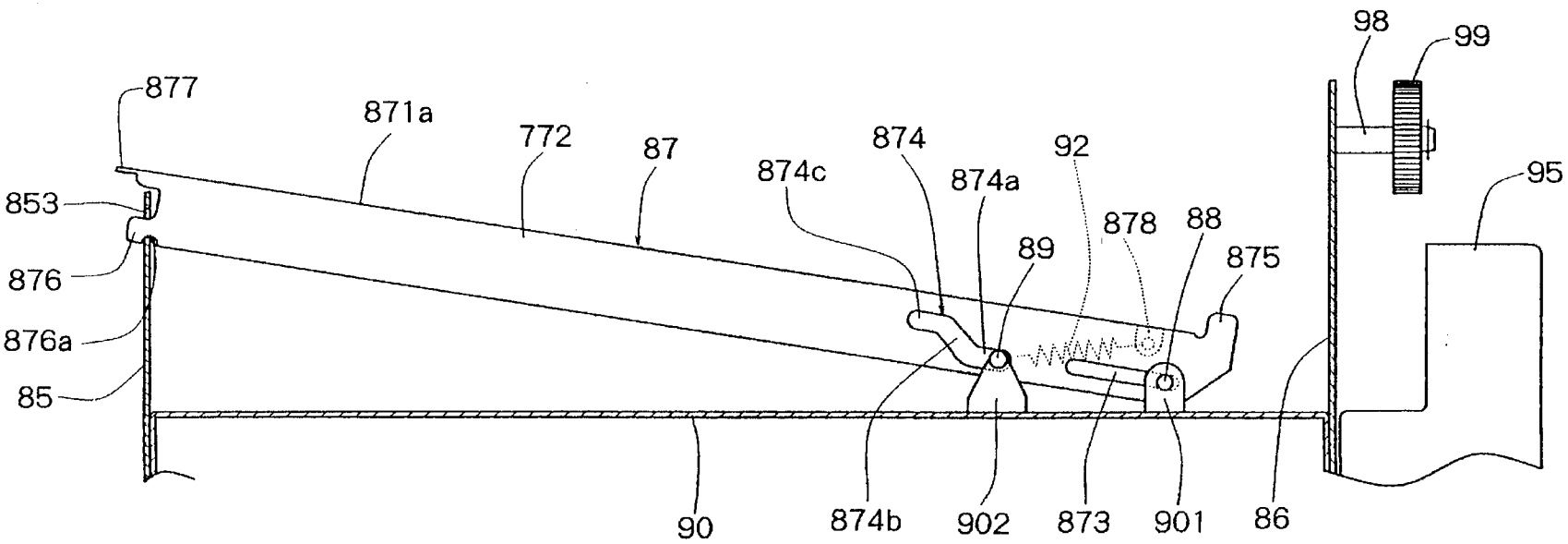
FIG. 16 is a side view showing a state in which the slider of FIG. 15 has been pulled out.
Figure 17:
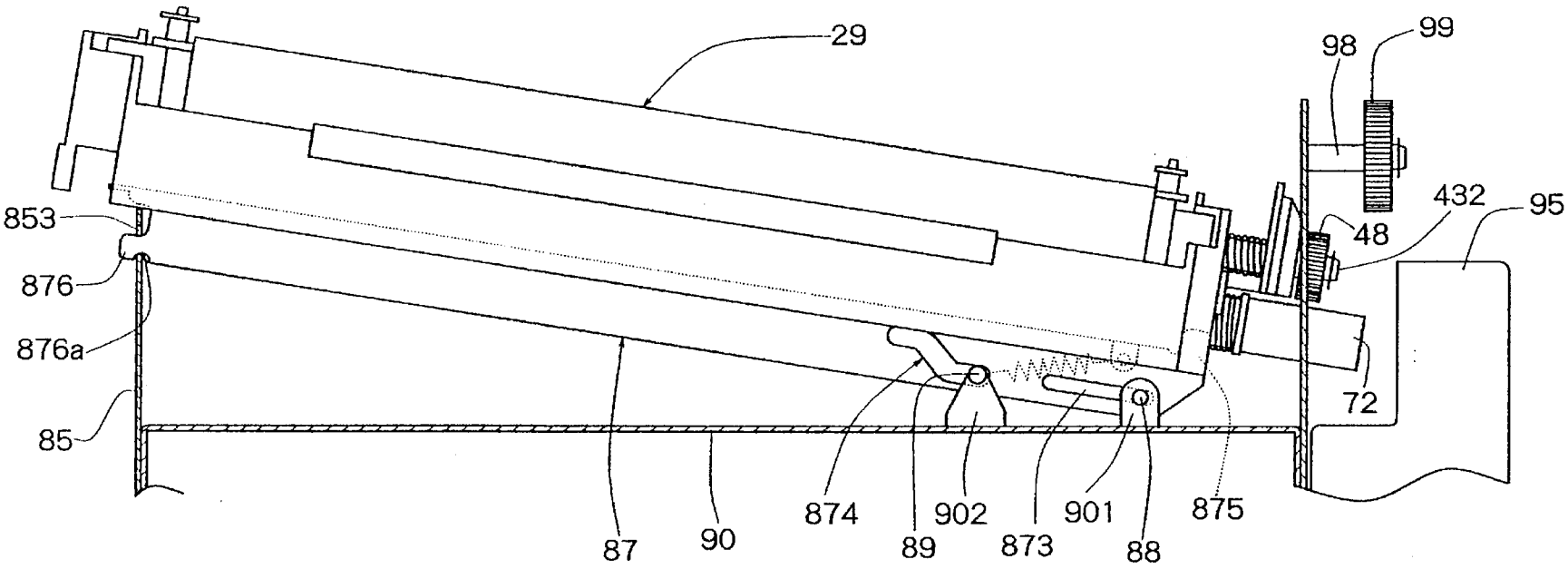
FIG. 17 is a side view showing a state in which the transfer belt unit is placed on the slider of FIG. 16.

On the base plate 90 of the lower housing 25 is disposed a slider 87 extending between the front side plate 85 and the rear side plate 86. The slider 87 is composed of a steel material a a channel-like cross section, and its width is consistent with the width of the slide surface 657 formed between the guides 655 and 656 of the slide rail 654 (see FIG. 3). The upper surface of its top plate 871 forms a bearing surface 871*a* for bearing the slide surface 657 of the slide rail 654. As seen in FIG. 15, in the opposite side plates 872, 872 of the slider 87 are provided first elongate holes 873, 873 and second elongate holes 874, 874, each extending in the back-and-forth direction toward the rear end portion (upwards in FIG. 12, leftwards in FIG. 15, and rightwards in FIGS. 16 to 19). The first elongate holes 873, 873 provided on the rear end side are formed in a straight line parallel to the bearing surface 871*a*. The second elongate holes 874, 874, provided toward the front end side relative to the first elongate holes 873, 873, include a first parallel portion 874*a* parallel to the bearing surface 871*a*, an inclined portion 871*b* inclined upwards from the front end of the first parallel portion 874*a*, and a second parallel portion 874*c* extending parallel to the bearing surface 871*a* toward the front end side from the upper end of the inclined portion 874*b*. At the rear ends of the opposite side plates 872, 872 are provided stoppers 875, 875 projecting upwardly of the bearing surface 871*a*. At the front ends of the opposite side plates 872, 872 are provided engagement portions 876 which fit into the hole 853 formed in the front side plate 85 (see FIGS. 13 and 16), and which have engagement depressions 876*a* for holding the slider 87 in an inclined state. At the front end of the top plate 871 is provided an engagement portion 877 which engages the engagement hole 633 formed in the front side wall 63 of the unit housing 60. The engagement portion 877 and the engagement hole 633 formed in the front side wall 63 constitute an engaging means in that they engage each other. The so constituted slider 87 has a first supporting pin 88 inserted into the first elongate holes 873, 873 formed in the opposite side plates 872, 872, and a second supporting pin 89 inserted into the second elongate holes 874, 874. The two ends each of the first and second supporting pins 88 and 89 are supported, respectively, by supporting brackets 901, 901 and 902, 902 formed by cutting and erecting a part of the base plate 90. The first elongate holes 873, 873 and the second elongate holes 874, 874 formed in the opposite side plates 872, 872 of the slider 87, and the first supporting pin 88 and the second supporting pin 89 supported, respectively, by the supporting brackets 901, 901 and 902, 902 constitute a supporting means which supports the slider 87 so as to be movable in the back-and-forth direction and to be free to pivot in the up-and-down direction about the rear end portion. A coiled tension spring 92 extends between the second supporting pin 89 and an engagement portion 878 provided in the top plate 871 of the slider 87 on the rear end side relative to the second supporting pin 89. Due to the tension of the coiled tension spring 92, the slider 87 is constantly urged toward the front end. Thus, the slider 87, as assembled, has its front end contacting the front side plate 85 (see FIG. 12). In this position, the first supporting pin 88 is situated nearly at the center of the first elongate holes 873, 873 formed in the opposite side plates 872, 872 of the slider 87, and the second supporting pin 89 is situated at the junction between the inclined portion 874*b* and the second parallel portion 874*c* of the second elongate holes 874, 874. When the front end portion of the slider 87 is lifted upward from this state, the slider 87 pivots about the first supporting pin 88, Simultaneously, the slider 87 is guided by the second elongate holes 874, 874 through which is inserted the second supporting pin 89, whereby the slider 87 moves toward the front end, and the engagement portions 876 reach the hole 853 formed in the front side plate 85. At this time, as shown in FIG. 16, the engagement portions 876 fit into the hole 853, and the lower edge of the hole 853 engages the engagement depressions 876*a* of the engagement portions 876. Thus, the slider 87 can be held in an inclined state in which its front end is situated upwards of the upper end of the front side plate 85. In this position, the rear ends of the first elongate holes 873, 873 are positioned at the first supporting pin 88, while the rear ends of the first parallel portions 874*a* of the second elongate holes 874, 874 are positioned at the second supporting pin 89.

Figure 18:
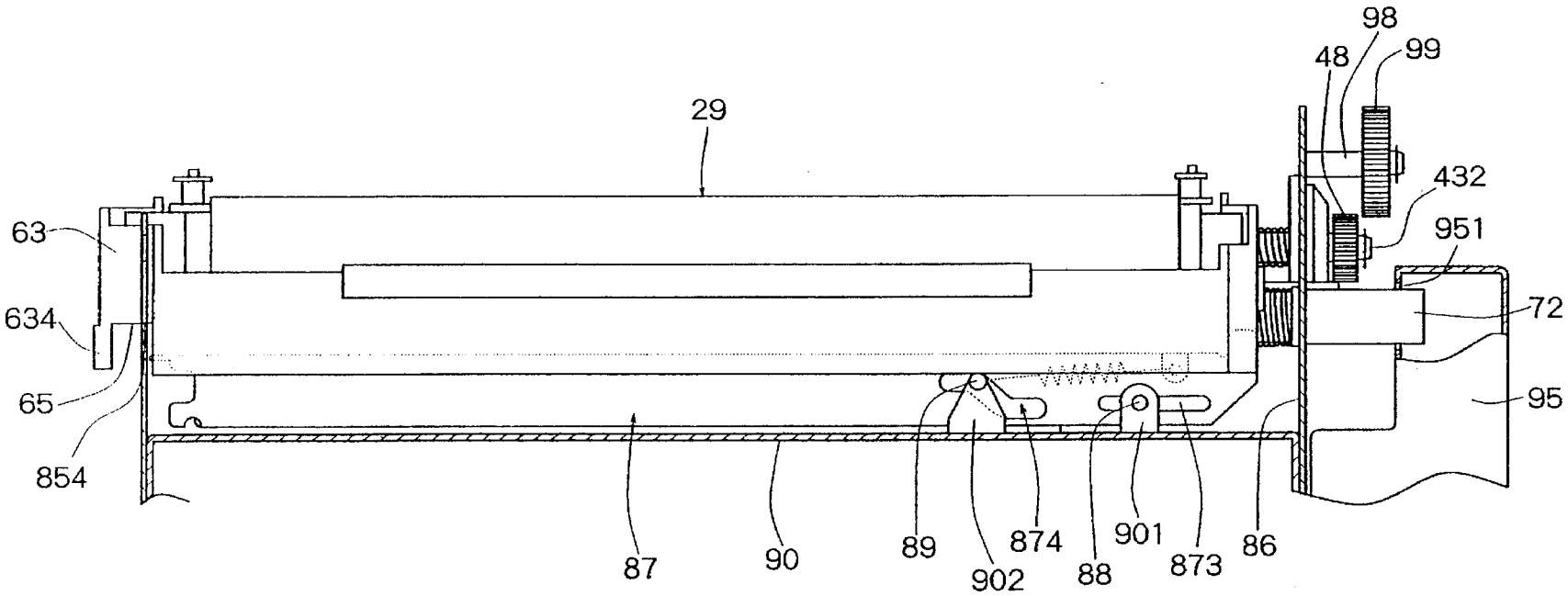
FIG. 18 is a side view showing a state in which the slider and the transfer belt unit have been pushed into the machine body housing after the state of FIG. 17 in which the transfer belt unit is placed on the slider.
Figure 19:
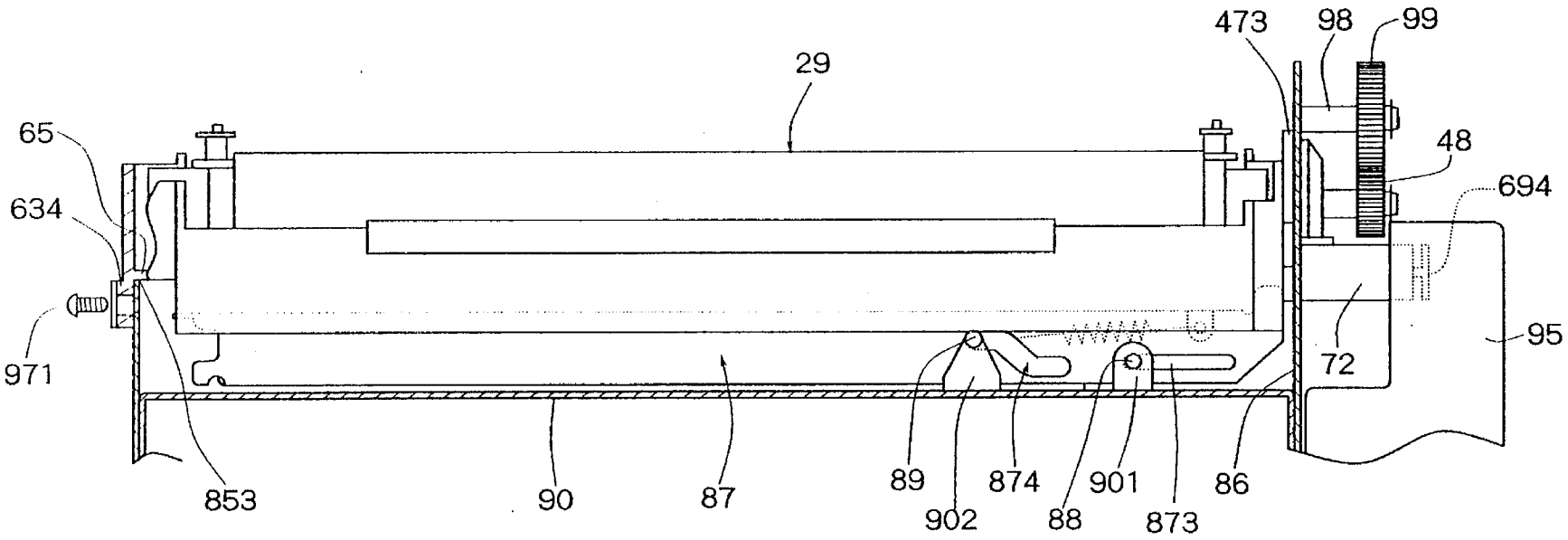
FIG. 19 is a side view showing a state in which the slider and the transfer belt unit have been moved to a predetermined mounting position of the machine body housing after the state of FIG. 18.

The slider mechanism for mounting the transfer belt unit 29 on the clamshell type lower housing 25 is constituted as described above. The procedure of mounting the transfer belt unit 29 will be explained. First, the front end portion of the slider 87 is lifted upwards, and the engagement depressions 876*a* of the engagement portions 876 are engaged with the lower edge of the hole 853 formed in the front side plate 85 to hold the slider 87 in an inclined condition as shown in FIG. 16. In this state, the slide surface 657 of the slide rail 654 formed in the unit housing 60 of the transfer belt unit 29 is placed on the bearing surface 871*a* of the slider 87. As the transfer belt unit 29 is moved along the bearing surface 871*a* of the slider 87 as far as the position illustrated in FIG. 17, the rear end of the slide rail 654 contacts the stoppers 875, 875 provided at the rear end of the slider 87. The engagement hole 633 formed in the front side wall 63 of the unit housing 60 engages the engagement portion 877 provided in the slider 87, whereby the transfer belt unit 29 and the slider 87 are integrated. At this time, the driven gear 48 mounted on the driving roller 43 of the transfer belt unit 29 has passed through the hole 861 formed in the rear side plate 86, and the guide portion 471 of the position restricting member 47 contacts the upper edge portion of the hole 861. Also, the blocking cylinder 72 fitted over the guide cylinder 693 of the toner carriage member 69 has been inserted into the hole 862 formed in the rear side plate 86. When the transfer belt unit 29 and the slider 87 are pushed rearward from the state of FIG. 17, the engagement portion 876 and the hole 853 are disengaged. Thus, the transfer belt unit 29 and the slider 87 are pivoted downward about the first supporting pin 88 and guided along the second elongate holes 874, 874 where the second supporting pin 89 has been inserted. When they come to a nearly horizontal condition as illustrated in FIG. 18, the bottom wall 65 aligning with the position of the mounting portion 634 of the front side wall 63 contacts a bottom edge 854 of the notched portion 852 formed in the front side plate 85. At this time, the position restricting member 47 is positioned because its guide portion 471, having a conical surface, is guided, and its fitting portion 472 is fitted, into the hole 861 formed in the rear side plate 86. At the same time, the flange portion 473 contacts the rear side plate 86. The blocking cylinder 72, fitted over the guide cylinder 693 of the toner carriage member 69, is inserted into a hole 951 provided in a waste toner box 95 disposed behind the rear side plate 86, and the flange 722 contacts the rear side plate 86. A smaller-diameter portion between the detachable member 46 mounted at the front end portion of the driving roller 43 and the gear 45 is fitted into the circular supporting hole 851, formed in the front side plate 85, from its upper opening. When the transfer belt unit 29 and the slider 87 are further pushed rearward from the state of FIG. 18, the mounting portion 634 contacts the front side plate 85 as shown in FIG. 19. At this time, the positioning hole 635 formed in the mounting portion 634 fits over a positioning pin 96 provided in the front side plate 85 as shown in FIG. 13. The detachable member 46 is guided on the conical surface of the guide portion 463, constituting the position restricting means 465, and moved in the circular supporting hole 851. The fitting portion 464 is fitted into the circular supporting hole 851 for positional restriction. In this condition, as illustrated in FIG. 13, a mounting bolt 971 is inserted into the hole 636 for passage of a mounting bolt that is formed in the mounting portion 634, and, screwed into a threaded hole formed in the front side plate 85. Simultaneously, mounting bolts 972 and 973 are inserted into the holes 461 and 462 for passage of mounting bolts that are formed in the detachable member 46, and are screwed into threaded holes formed in the front side plate 85. Thereby, the transfer belt unit 29 can be mounted and fixed on the clamshell type lower housing 25. On the rear end side of the transfer belt unit 29, as shown in FIG. 19, the driven gear 48, mounted on the driving roller 43, is meshed with a transmission gear 99, mounted rotatably on a short shaft 98 attached to the rear side plate 86, and connected transmissibly to a driving unit (not shown). In the blocking cylinder 72 fitted over the guide cylinder 693 of the toner carriage member 69, the front end portion of the guide cylinder 693 protrudes from the blocking cylinder 72 into the waste toner box 95, since the flange 722 pressed against the rear side plate 86 is immobile, but the guide cylinder 693 moves. Thus, waste toner carried by the toner carriage member 69 can be discharged. To detach the transfer belt unit 29, mounted on the lower housing 25 this way, for replacement of parts and so forth, a procedure reverse to the above-described mounting procedure is performed, whereby detachment can be carried out easily.

Figure 20:
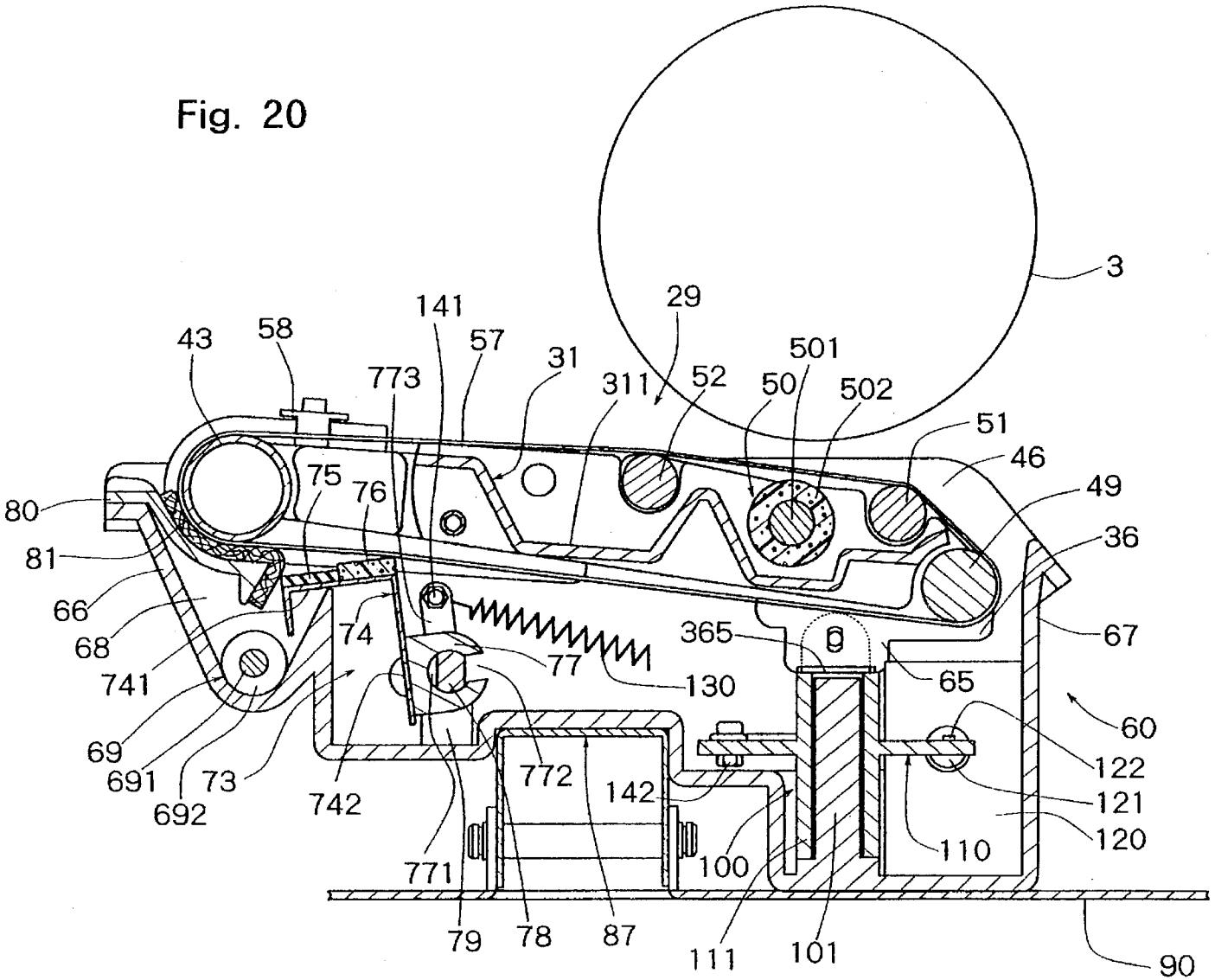
FIG. 20 is a sectional view of the transfer device mounted on the machine body housing.
Figure 21:
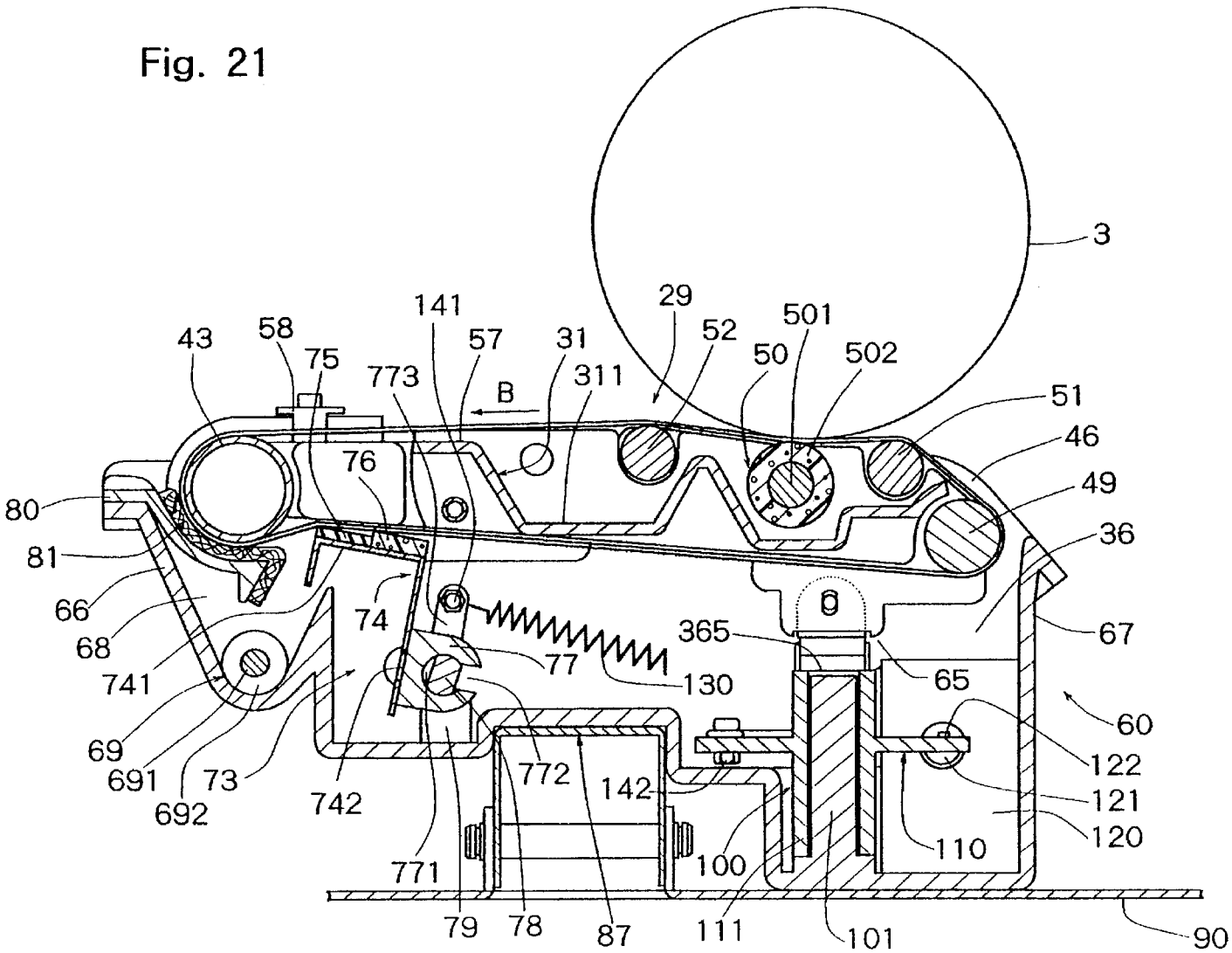
FIG. 21 is a sectional view showing the transfer device mounted on the machine body housing and brought to the transfer state.

The positional relationship between the image bearing member 3 and the transfer belt unit 29 mounted on the lower housing 25 constituting the clamshell type machine body housing is shown in FIG. 20. The transfer roller 50 of the transfer belt unit 29 is positioned nearly directly below the image bearing member 3, and there is a gap between the transfer belt 57 and the image bearing member 3. There is also a 1.00 to 2.00 mm gap between the transfer belt 57 and the transfer roller 50. The belt unit 30 of the transfer belt unit 29, mounted on the lower housing 25 constituting the machine body housing, is pivoted upwards about the driving roller 43 by the actuation of the contacting/separating mechanisms 150, 150 at the time of transfer, and is brought to a transfer position. Consequently, as shown in FIG. 21, the transfer belt 57 in is contact with the outer peripheral surface of the image bearing member 3 and is also pressed by the transfer roller 50.

The transfer device of an image forming machine according to the illustrated embodiment is constituted as described above. Its actions will be explained hereinbelow. When the image forming machine is actuated from the non-operating state of the transfer belt unit 29 (FIG. 20), the solenoid 120, constituting the multi-directional driving mechanism 100 is, energized. When the solenoid 120 is energized and the plunger 121 attracted, the moving plate 110 is moved through a predetermined angle in the direction of arrow E (FIG. 11) about the supporting shaft 101. Upon the movement of the moving plate 110 in the direction of arrow E, the coupling rods 160 and 160, having one end of each thereof coupled to the output portions 114 and 115 of the moving plate 110, are each pulled toward the moving plate 110. At the pull of the coupling rods 160 and 160 toward the moving plate 110, the contacting/separating mechanisms 150 and 150, having the operated lever portions 157 and 157 coupled to the other end of the coupling rods 160 and 160, are pivoted through a predetermined angle about the supporting shafts 165 and 165, thereby bringing the rollers 156 and 156 to their nearly uppermost positions. Thus, the supporting plates 35 and 36 of the belt unit 30, having mounted thereto the placing plates 355, 365 which rest on the rollers 156 and 156, are rotated upwards about the driving roller 43 and are pushed up (see also FIG. 7). As a result, as shown in FIG. 21, the transfer belt 57 is pressed against the image bearing member 3, and the transfer roller 50 is pressed against the transfer belt 57. By this contact under pressure, the roller portion of the transfer roller 50 is compressed by about 0.5 to 1.0 mm, and thus the transfer belt 57 can be contacted uniformly with the image bearing member 3 under a predetermined pressure. On the other hand, the coiled spring 130, having one end coupled to the moving plate 110, is pulled toward the moving plate 110. Thus, the mounting member 77, equipped with the operated lever 773 coupled to the other end of the coiled spring 130, is pivoted clockwise in FIG. 20 about the supporting shaft 78. Consequently, the holder 74, having the mounting member 77 mounted thereon, is moved to the operating position shown in FIG. 21, so that the edge portion of the cleaning blade 75 mounted on the holder 74 is pressed against the transfer belt 57. Also, that edge portion of the paper dust removing member 76 mounted likewise on the holder 74 which is on the cleaning blade 75 side is brought into contact with the transfer belt 57.

Next, when the driven gear 48 is rotationally driven via the transmission gear 99, transmissibly connected to the driving unit (not shown), the driving roller 43 having the driven gear 48 mounted thereon is caused to rotate. Upon its rotation, the transfer belt 57 is actuated in the direction of arrow B. Also, with the rotation of the driving roller 43, the driven gear 70 is rotated via the gear 45 mounted on the driving roller 43 and the intermediate gear 71. When the driven gear 70 is rotated, the toner carriage member 69, having the driven gear 70 mounted thereon, is rotated. Separately, the transfer roller 50 receives a predetermined voltage from the voltage applying means 200 (see FIG. 1). Via the transfer roller 50, a charge of a predetermined polarity is imposed on the transfer belt 57. Therefore, when a transfer paper is fed between the image bearing member 3 and the transfer belt 57, a toner image formed on the surface of the image bearing member 3 is sequentially attracted and transferred to the transfer paper by the action of the charge applied to the transfer belt 57 at the transfer portion where the image bearing member 3 and the transfer belt 57 face each other. The transfer paper having the toner image transferred thereto is conveyed by the transfer belt 57, has the toner image fixed by the fixing roller pair 23, and is discharged from the discharge roller pair 24. The toner adhered to the surface of the transfer belt 57 is scraped off by the cleaning blade 75 during travel in the direction of arrow B, and is caused to fall into the waste toner accommodating portion 68. The toner dropped there is carried rearwards by the toner carriage member 69 and discharged into the waste toner box 95 from the front end of the guide cylinder 693.

Then, at the time of a non-transfer operation, the driving roller 43 is stopped, and the voltage applied to the transfer roller 50 is shut off. When the solenoid 120 is deenergized, the plunger 121 is returned by means of a built-in return spring, the moving plate 110 is pivoted in the direction of arrow F (FIG. 11) about the supporting shaft 101, coming to the original state. Upon movement of the moving plate 110 in the direction of arrow F, the coupling rods 160 and 160 are pushed forwards and rearwards, respectively. Thus, the contacting/separating mechanisms 160 and 160 are pivoted through a predetermined angle about the supporting shafts 165 and 165 in directions reverse to those during transfer. Hence, the belt unit 30 is pivoted downwards about the driving roller 43, whereupon the placing plates 355, 365 mounted on the supporting plates 35 and 36 contact the stoppers 652 and 653 formed protrusively on the bottom wall 65 of the unit housing 60, and stop there. A state at the non-transfer position shown in FIG. 20 is produced. That is, the image bearing member 3 and the transfer belt 57, as well as the transfer belt 57 and the transfer roller 50 are separated from each other. This can prevent the deformation of the transfer roller 50 arising from constant contact of the transfer roller 50 with the transfer belt 57. On the other hand, the coiled spring 130, having one end coupled to the moving plate 110, is also released, so that the mounting member 77 having the operated lever 773 connected to the other end of the coiled spring 130 is pivoted counterclockwise in FIG. 20 about the supporting shaft 78. Consequently, the holder 74 having the mounting member 77 mounted thereon is moved to the position shown in FIG. 20, and thus the cleaning blade 75 mounted on the holder 74 separates from the transfer belt 57. This can prevent the deformation of the transfer belt 57 from arising due to the constant contact of the cleaning blade 75 with the transfer belt 57. In this condition as well, that edge portion of the paper dust removing member 76, mounted likewise on the holder 74, which is opposite to the cleaning blade 75 side is in contact with the transfer belt 57. Since the paper dust removing member 76 is in constant contact with the transfer belt 57, the toner remaining adhered at the position of contact of the cleaning blade 75 with the transfer belt 57 at the time of separation of the belt unit 30 is smoothed by the paper dust removing member 76 even if the toner moves under the inertia of the transfer belt for a period until its stoppage. At a next transfer, therefore, toner build-up adhered to the transfer belt can be prevented from falling into the machine.

The embodiments in which the multi-directional driving mechanism of the present invention is used most effectively in the transfer device of an image forming machine have been described above. However, the present invention is in no way restricted to these embodiments, and is applicable to various devices that produce outputs in a plurality of directions by means of a single solenoid.

As described above, the multi-directional driving mechanism according to the first aspect of the present invention comprises a moving plate supported rotatably on a supporting shaft and having an input portion and a plurality of output portions; a solenoid coupled to the input portion of the moving plate for causing the moving plate to pivot through a predetermined angle; and a plurality of coupling members each having one end thereof coupled to the plurality of output portions provided on the moving plate. Thus, it can serve as an inexpensive, simple-structure, multi-directional driving mechanism which can produce outputs in a plurality of directions by means of a single solenoid.

The transfer device of an image forming machine according to the second aspect of the present invention uses such a multi-directional driving mechanism to actuate a contacting/separating mechanism for moving the belt unit between a transfer position and a non-transfer position, and a moving mechanism for moving the cleaning means, which differ the contacting/separating mechanism in terms of the direction of movement, between an operating position and a non-operating position. Thus, the transfer device of an image forming machine can be simple in structure and low in price.

According to the second aspect of the present invention, moreover, the coupling member for coupling the output portion of the moving plate in the multi-directional driving mechanism to the moving mechanism for moving the cleaning means is constituted of a coiled spring. Thus, a tensile force is imparted to the coiled spring when the cleaning blade is brought to an operating position during transfer. Even when the transfer belt is stretched, the cleaning blade is kept pressed against the transfer belt owing to the tensile force of the coiled spring. Thus, a cleaning function can be provided constantly.

Furthermore, according to the second aspect of the present invention, the coupling members for coupling the output portions of the moving plate in the multi-directional driving mechanism to the contacting/separating mechanisms for moving the belt unit are composed of coupling rods having bends at the middle of each. These bends can accommodate manufacturing errors in the distances between the moving plate and the contacting/separating mechanisms when mounted. Thus, the contacting/separating mechanisms can be moved constantly smoothly.

What we claim is:

1. A multi-directional driving mechanism comprising:

a supporting shaft;

a moving plate supported pivotably on the supporting shaft and having an input portion and a plurality of output portions;

a solenoid coupled to the input portion of the moving plate for causing the moving plate to pivot through a predetermined angle on said supporting shaft; and a plurality of coupling members, each coupling member having a first end coupled to one of the plurality of output portions provided on the moving plate and a second end adapted to be coupled to an output member, for moving the output member in response to pivoting of the moving plate due to actuation of the solenoid.

2. A transfer device for an image forming machine having an image bearing member, said transfer device comprising:

a belt unit including a driving roller, a driven roller disposed at a distance from the driving roller, and a transfer belt looped around the driving roller and the driven roller and adapted to be disposed opposite the image bearing member;

cleaning means disposed on the side of the transfer belt loop opposite the side which is adapted to be adjacent the image bearing member, for cleaning a surface of the transfer belt;

a multi-directional driving mechanism including a contacting/separating unit for moving the belt unit between a transfer position and a non-transfer position, a moving mechanism for moving the cleaning means between an operating position and a non-operating position, a supporting shaft, a moving plate supported pivotably on the supporting shaft and having an input portion and a plurality of output portions, a causing the moving plate to pivot through a predetermined angle, and a plurality of coupling members, each coupling member having a first end coupled to one of the plurality of output portions on the moving plate and a second end coupled to the contacting/separating unit or the moving mechanism.

3. The transfer device of claim 2, wherein one coupling member comprises a coiled spring having its second end coupled to the moving mechanism.

4. The transfer device of claim 2, wherein one of the coupling members comprises a coupling rod having a bend substantially at the middle thereof and having its second end coupled to the contacting/separating unit.

5. The transfer device of claim 2, wherein said contacting/separating unit comprises first and second contacting/separating mechanisms for contacting the belt unit at first and second spaced apart locations.

6. The transfer device of claim 5, wherein first and second ones of the coupling members comprise coupling rods, each coupling rod having a bend substantially at the middle thereof and having its second end coupled to a respective one of said first and second contacting/separating mechanisms.

7. A multi-directional driving mechanism comprising:

a supporting shaft;

a moving plate supported pivotably on the supporting shaft and having an input portion and a plurality of output portions, the input portion adapted to be coupled to a solenoid, for causing the moving plate to pivot through a predetermined angle on said supporting shaft upon actuation of the solenoid; and a plurality of coupling members, each coupling member having a first end coupled to one of the plurality of output portions provided on the moving plate and a second end adapted to be coupled to an output member, for moving the output member in response to pivoting of the moving plate due to actuation of the solenoid.

* * * * *